United States Patent [19]

Hanses

[11] 4,260,311

[45] Apr. 7, 1981

[54] METHOD OF AND APPARATUS FOR HIGH SPEED PRODUCTION OF ABSORBENT PAD LINED RECTANGULAR SLOPING WALLED POLYSTYRENE FOAM MEAT PACKAGING TRAYS

[75] Inventor: Mark J. Hanses, Fresno, Calif.

[73] Assignee: Standard Oil Company (Indiana), Chicago, Ill.

[21] Appl. No.: 61,831

[22] Filed: Jul. 30, 1979

[51] Int. Cl.[3] ..... B65H 3/08

[52] U.S. Cl. ..... 414/129; 156/196; 156/521; 198/408; 198/532; 198/625; 221/222; 221/242; 414/94; 414/900; 426/124

[58] Field of Search ..... 156/521, 196; 221/222, 221/242; 53/237, 238, 240, 472; 425/150; 426/392, 398, 106, 112, 110, 119, 124; 206/557; 198/406, 408, 531, 532, 625; 414/129, 94, 900

[56] References Cited

U.S. PATENT DOCUMENTS

| | | | |
|---|---|---|---|
| 2,227,378 | 12/1940 | Milmoe et al. | 53/238 X |
| 2,606,681 | 8/1952 | Ridenour | 156/521 X |
| 2,756,864 | 7/1956 | Laxo | 198/625 |
| 3,026,209 | 3/1962 | Niblack et al. | 426/124 |
| 3,209,978 | 10/1965 | Dupuis | 426/124 X |
| 3,329,550 | 7/1967 | Kucheck | 156/541 X |
| 3,379,537 | 4/1968 | Brandt | 426/124 X |
| 3,712,483 | 1/1973 | Messervey | 414/94 |
| 3,830,611 | 8/1974 | Irwin | 425/150 X |
| 4,042,148 | 8/1977 | Gerben | 221/222 |
| 4,141,193 | 2/1979 | Joa | 198/408 X |

*Primary Examiner*—David A. Simmons
*Attorney, Agent, or Firm*—Robert R. Cochran

[57] ABSTRACT

The basic structure of the tray of the invention is specially designed to be produced in a high speed hot polystyrene foam press (such as shown in U.S. Pat. No. 3,830,611) and the invention matches the production rate of this basic tray structure by a method and apparatus which denests the press product to effect its conversion in a horizontal serial fed chain conveyor operation, to absorbent pad lined trays, this operation automatically concluding with recompacting the finished product in a horizontal column delivered onto a counter for manual packaging.

4 Claims, 32 Drawing Figures

FIG. 4.
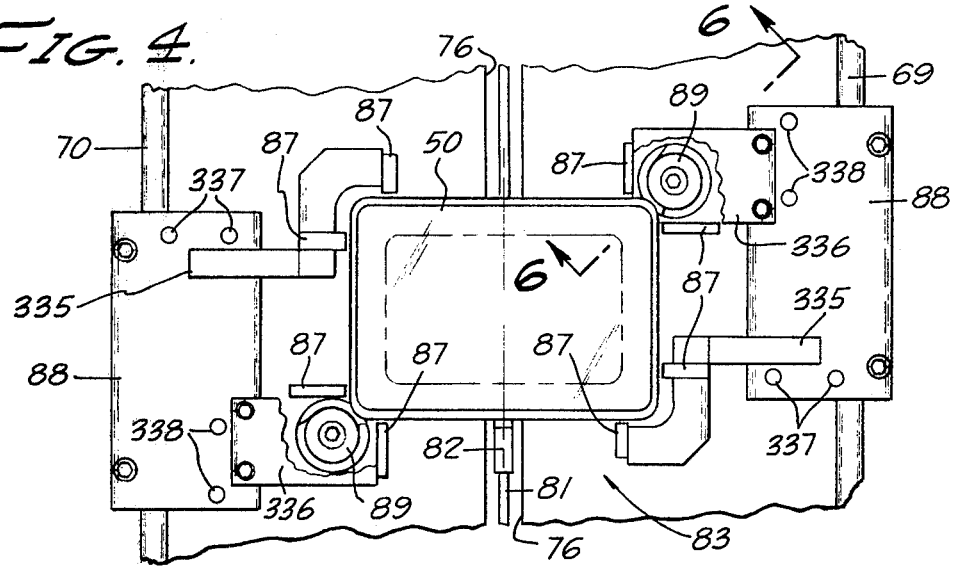
FIG. 6.
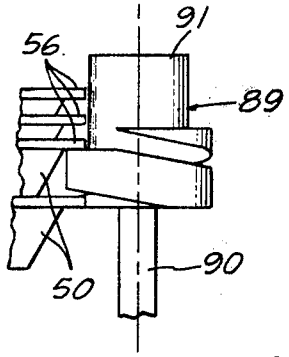
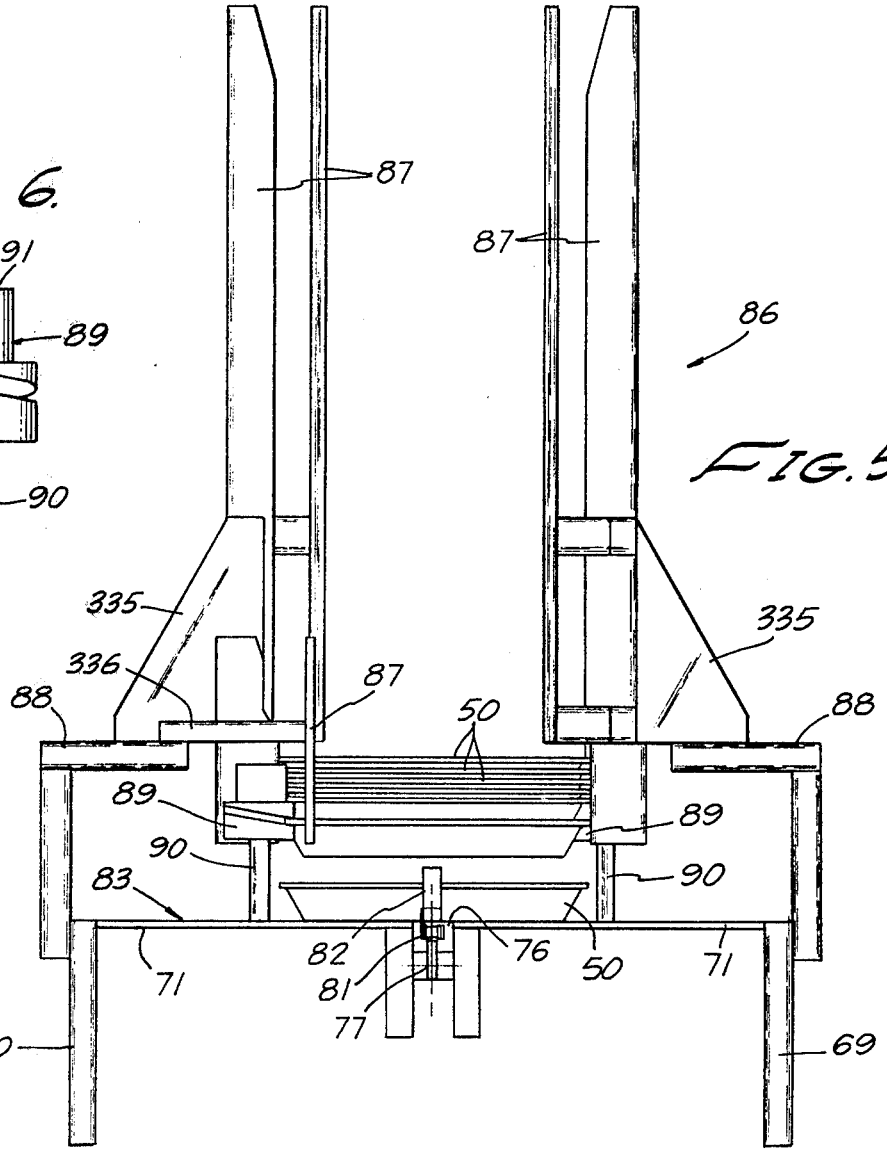
FIG. 5.

METHOD OF AND APPARATUS FOR HIGH SPEED PRODUCTION OF ABSORBENT PAD LINED RECTANGULAR SLOPING WALLED POLYSTYRENE FOAM MEAT PACKAGING TRAYS

SUMMARY OF THE INVENTION

Economies realized by recent improvements in high precision presses in the mass production of polystyrene foam food packaging trays has greatly expanded the use of such trays, particularly in the packaging of raw freshly butchered meat.

Unless immediately frozen and kept under refrigeration, such packaged meat accumulates blood and water in the tray which offends many customers upon opening the package.

It is therefore a primary object of the present invention to provide a method and apparatus operating at such a high speed as to accommodate itself to the full output of a modern high capacity hot sheet polystyrene foam press and provide each tray with an absorbent pad which will be adhesively held in place and wherein, the trays so padded will then be automatically delivered in compactly nested restacked relation on a counter for the completed product to be packaged for shipment.

Another object of said invention is to provide such a method and apparatus which will form the absorbent pads by drawing a continuous strip of absorbent material from a roll of the same, cutting pads progressively from the end of said strip as so fed, each pad, after being severed from the strip being transferred to a means for applying adhesive to a middle portion of the pad and then applying the pad properly oriented with the tray with the adhesive compressed between the pad and the tray.

A further object of the invention is to provide a device feeding said absorbent material to said pad cutter with annular rows of teeth so that a strip of absorbent material covered on one face with a water repellant sheet, such as polyethylene, may be used, whereby the upper face of each pad will be covered with said water repellant sheet and wherein the teeth in said strip feeding device will perforate said water repellant sheet to form lines of perforations in the pad through which moisture in the packaged product may drain to lodge in the pad whereby the wholesomeness of the packaged product will be preserved.

A yet further object of the invention is to provide a constantly rotating pair of large diameter tangent rotors between which each pad is fed, the upper rotor peripherally exuding adhesive onto the pad, the lower rotor having three legs, the feet of which successively apply suction to pick up a pad as it is fed between the rotors and to apply air pressure to release the pad after pressing the latter into a tray conveyed into conjunction with the pad delivery rotor, whereby the adhesive on the pad retains the pad, glued to the tray.

Yet another object of the invention is to provide such a pair of tangent rotors, the upper of which is relatively narrow so as to grip only a middle portion of a pad and apply adhesive only to the upper face of said middle portion, lateral portions of the pad being embraced by local power driven guide belts for stabilizing the travel of each pad from the point where it becomes severed from the strip of absorbent material to the place where its leading edge is pinched between said rotors and siezed by the vacuum operating from a rising leg of the lower rotor, thereby wrapping the pad about said vacuum occupied foot and rolling it against the adhesive rotor to wipe the pad with two central streaks of glue which are pressed against the inside surface of the bottom of the tray delivered by the conveyor to receive the pad, the vacuum being then replaced by compressed air in the rotor foot delivering the pad so the latter is firmly retained in its tray by the glue applied on said pad.

BRIEF DESCRIPTION OF THE DRAWINGS

FIG. 4 is an enlarged plan view of the tray denester of the invention.

FIG. 5 is an enlarged front elevational view of FIG. 4.

FIG. 6 is an enlarged fragmentary vertical sectional view taken on line 6—6 of FIG. 4 showing one of the tray stack denesting screws of the invention.

DETAILED DESCRIPTION OF THE PREFERRED EMBODIMENT

Figure 29:
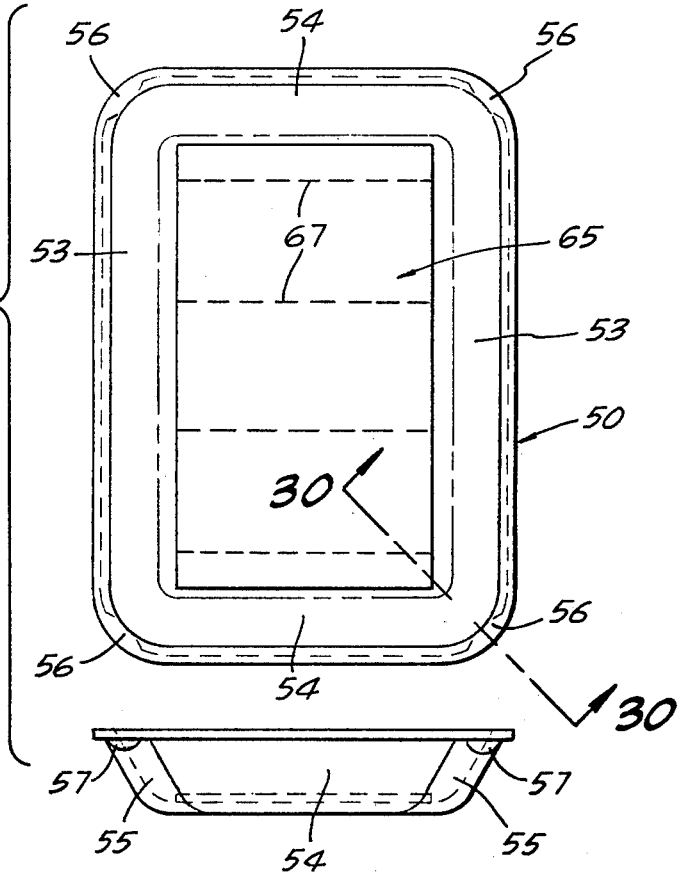
FIG. 29 is a plan view of a particular style of tray designed expressly for use in the present invention, and showing this after its being padded and expelled from the machine.
Figure 30:
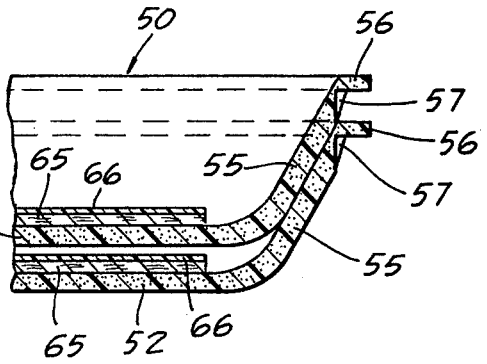
FIG. 30 is an enlarged detail sectional view taken on line 30—30 of FIG. 29 and illustrating the distinctive coplanar diagonally opposite corner flanges provided in this style of tray to facilitate its uniform response to the device of the invention for denesting compacted trays and feeding them singly in properly spaced relation to the pad applicator of the invention.
Figure 31:
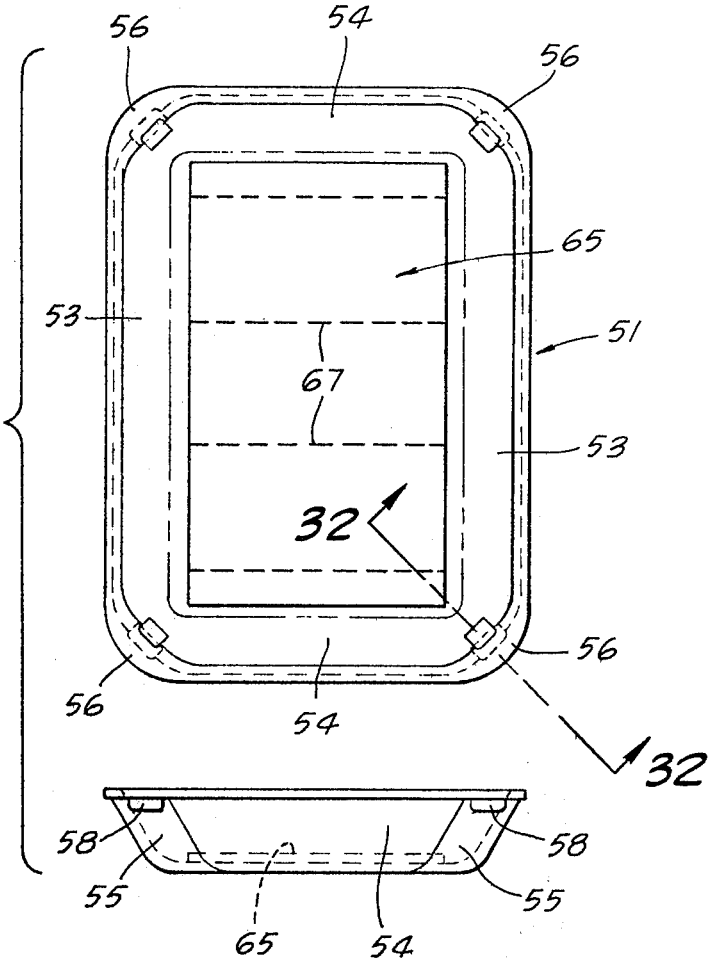
FIG. 31 is a plan and end elevational view of an alternate style of tray employable in connection with the invention.
Figure 32:
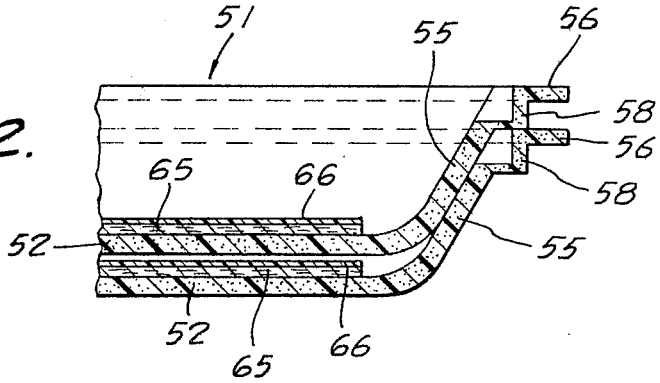
FIG. 32 is an enlarged detailed sectional view taken on the line 32—32 of FIG. 31 and illustrating the unique corner construction of this alternative design of tray.

Inasmuch as certain unique details of the product of the invention are provided for the express purpose of facilitating the functioning of the invention in producing the product, the detailed description of the invention will be prefaced by describing the structure of two optional types of rectangular sloping-walled polystyrene-foam meat-packaging trays 50 and 51, which are illustrated, respectively, in FIGS. 29 and 30; and in FIGS. 31 and 32.

Basic structures of optional trays 50 and 51 are alike and include a flat rectangular tray bottom 52, outwardly beaded sloping side and end walls 53 and 54, joined by rounded dimpled corners 55, the extremities of which lie flush with the opening plane of the tray and offer flat horizontal tray corner supporting flanges 56.

The corners 55 of the optional tray 50 have cylindrical external dimples 57 formed inwardly therein thereby widening supporting flanges 56.

The corners 55 of the optional tray 51 have internal dimples 58 formed outwardly therefrom to rest on top of the tray nested therebeneath thus reducing the tendency of nested trays 51 to resist separation.

The present invention provides for rapidly producing either of the basic tray structures above described as in a modern hot polystyrene foam press equipped with matched molds as disclosed in the U.S. Pat. to Jere F. Irwin (supra), the invention also providing an apparatus 60 having an ample capacity for accepting and processing the entire press output of either of the styles of meat packaging trays 50 or 51 whereby each tray is provided with an absorbent pad 65 fitting inside the tray bottom 52 and glued thereto, said apparatus 60 concluding its automatic continuous operation by recompacting the trays, now pad lined, on a horizontal counter for manual packaging.

Each pad 65 preferably embodies a water repellant cover 66 such as a light film of polyethylene having lines of perforations 67 through which moisture draining from a packaged product may have access to the absorbent material of pad 65 and be stored there, out of contact with the packaged product.

Figure 1:
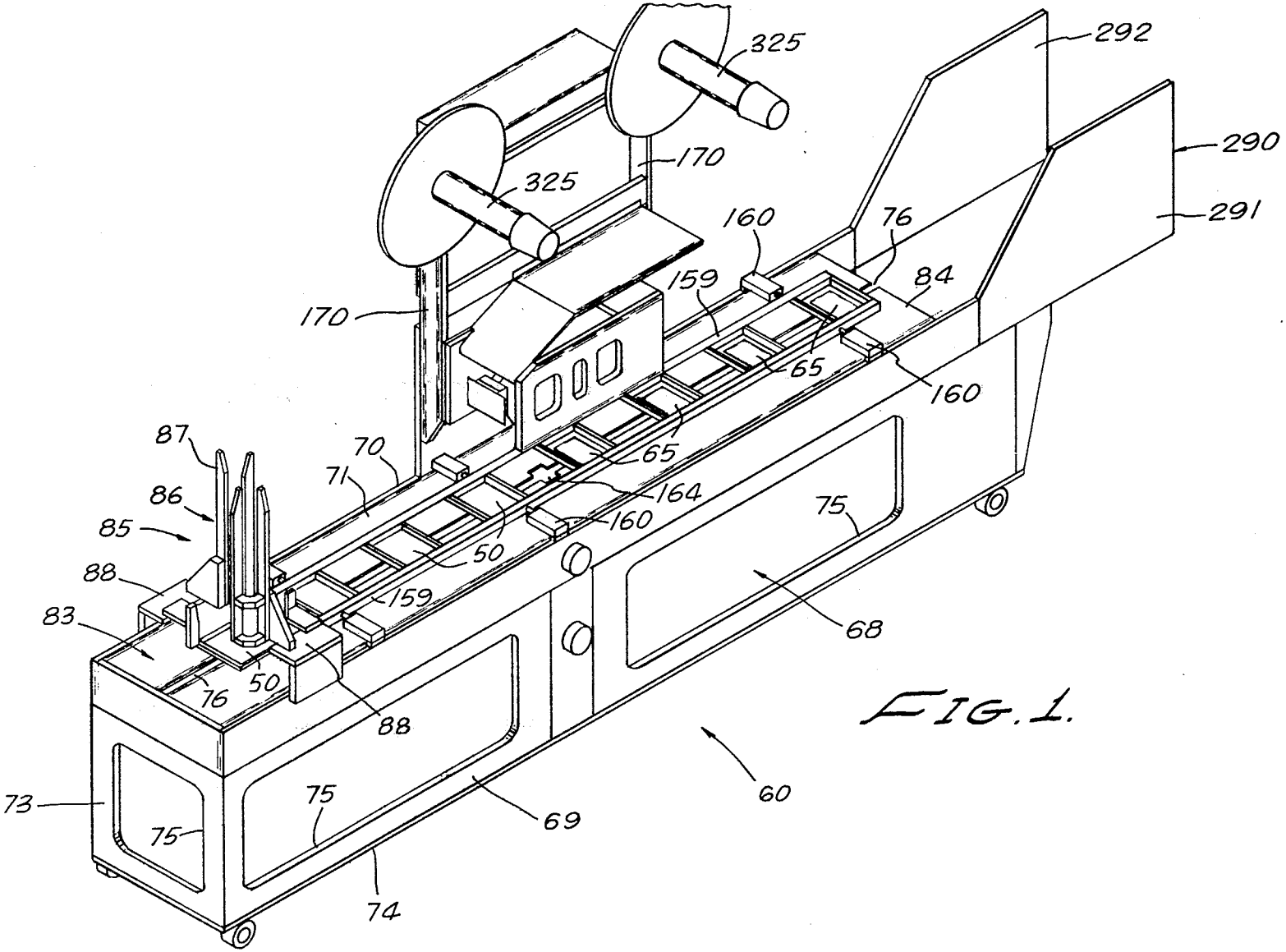
FIG. 1 is a general diagrammatic perspective view of the invention.
Figure 2:
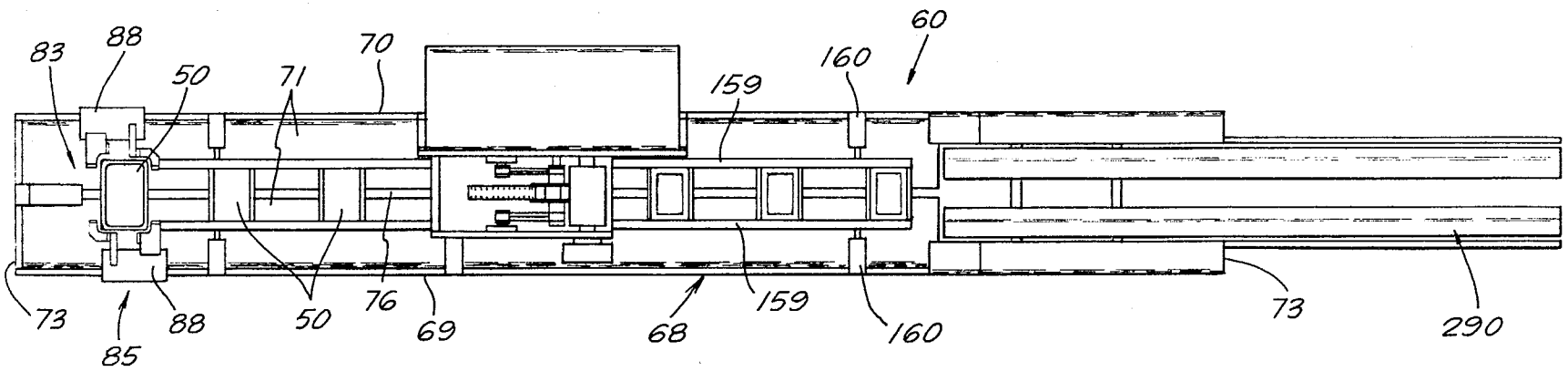
FIG. 2 is a diagrammatic plan view of the invention.
Figure 3:
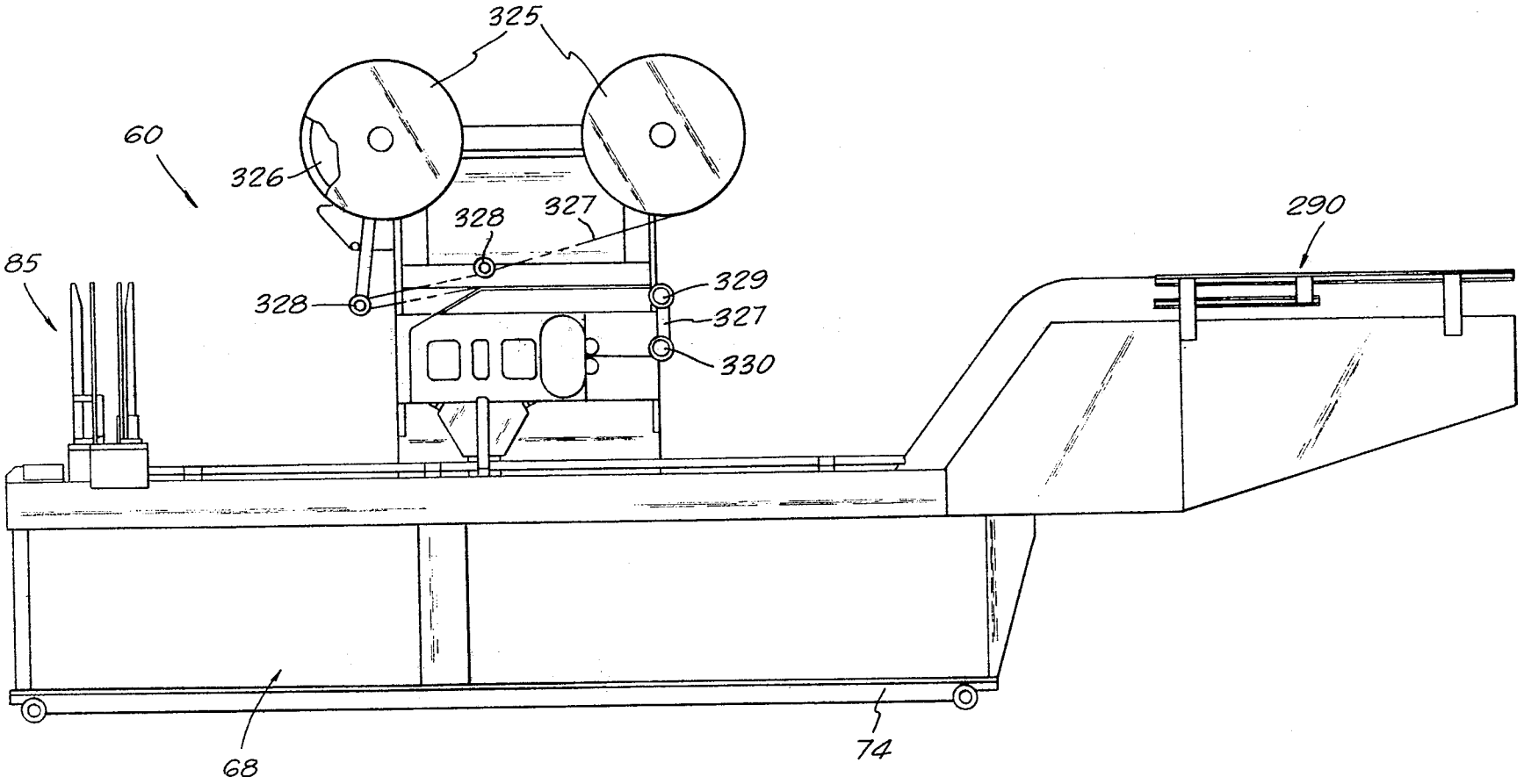
FIG. 3 is a side elevational view of FIG. 2.

The apparatus 60 of the invention is preferably incorporated with an elongated rectangular boxlike housing 68, the general character of which is clearly shown in the diagrammatic perspective, plan and front elevational views thereof in FIGS. 1, 2, and 3. The housing 68 includes front and rear side walls 69 and 70, which are united by top and bottom decks 71 and 72 and by end walls 73. The bottom deck 72 is fixed upon a low-profiled wheeled dolley 74 for moving the apparatus 60 from place to place on a factory floor. Suitable windows 75 are provided in said walls for giving ready access to the interior of said housing.

Extending centrally through the entire length of the top deck 71 is a narrow slot 76. Supported in the plane of said slot just beneath top deck 71 and coextensive therewith is a flat bar 77 on which the upper flight 80 of an endless conveyor chain 81 travels. An endless series of equally spaced tray propelling lugs 82 are mounted on chain 81 so as to extend upwardly from its upper flight 80 through slot 76 while travelling through a tray receiving end area 83 of top deck 71 and to the opposite discharge end 84 thereof.

Mounted on a vertical axis A on the bottom deck 72 and top deck 71 at the front end of the housing 68 is a stack tray denester 85 which includes an adjustable tray magazine 86 formed by a series of vertical guide bars 87 which are rigidly but adjustably screwed to a pair of low level cantilever platforms 88 rigidly fixed upon upper edges of side walls 69 and 70 and extending short distances inwardly over the tray receiving area 83 of top deck 71.

Assuming that the apparatus 60 is normally used in applying absorbent pads 65 to the preferred form of optional tray 50, the present description will be restricted to such use. The apparatus 60 is thus positioned conveniently with its magazine 86 juxtaposed with the delivery end of the hot sheet polystyrene press employed to rapidly produce the basic structure referred to above as the tray 50. These trays are already nested in stacks and are readily transferred manually to magazine 86 keeping this freshly loaded with columnized trays 50, which gravitate downwardly until diagonal flanges 56 of the bottom tray in the magazine come into contact with inwardly projecting upwardly exposed horizontal faces of a pair of denester screws 89 mounted on upper ends of a pair of vertical shafts 90. These screws preferably have a diameter of one and threequarter inches and a pitch of about one inch and a length of slightly over one inch. Each screw 89 has a hub 91 one and one-half inches in diameter extending upwardly one and one-quarter inches.

Referring now particularly to FIGS. 7 to 11, inclusive, it will be noted that the stacked tray denester 85 is rigidly mounted on the cover plate 95 of an inverted U-shaped base 96 which is bolted to the lower deck 72 of the housing 68. The cover plate 95 has a central vertical hole 97 which is concentric with the axis A of the tray denester 85 (see FIG. 8). Mounted within the base 96 is a mitered gear drive transmission 98 from which a shaft 99 extends laterally and has secured thereto a drive sprocket 100 on which a timing lugged belt 101 is trained for driving the denester 85. The transmission 98 transmits rotation from the input shaft 99 to a vertical output shaft 102 which is fitted with a double splined sleeve 103 and extends upwardly into a counter bore 104 provided in the lower end of a hollow upwardly tapering mandrel 105 having a heavy annular mounting flange 110 which is solidly bolted to the base coverplate 95 in concentric relation with axis A.

Held in telescopic relation with mandrel 105 by suitable ball bearings is a lower external sleeve 111 and an upper internal sleeve 112. Rigidly secured to the upper end of the upper sleeve 112 is a shallow circular gear box 113 from which a drive shaft 114 extends downwardly through the mandrel 105 to make a splined connection with double spline sleeve 103 and having mounted on its upper end a drive gear 115 which meshes with two driven gears 116 having vertical driven shafts 117 which extend upwardly and downwardly from gear box 113 through suitable ball bearings provided by said gear box, for journalling these shafts.

For purposes of assuring stability in the machine being described, the shallow circular gear box 113 has secured thereto diametrically separated bearing and driven shaft housings 118 which extend vertically downwardly from their connections with gear box 113 and terminate coextensively at their lower ends in pivot pins 119.

Fixed on the upwardly extending end portions of shafts 117 are like timing belt drive pulleys 120.

Figure 11:
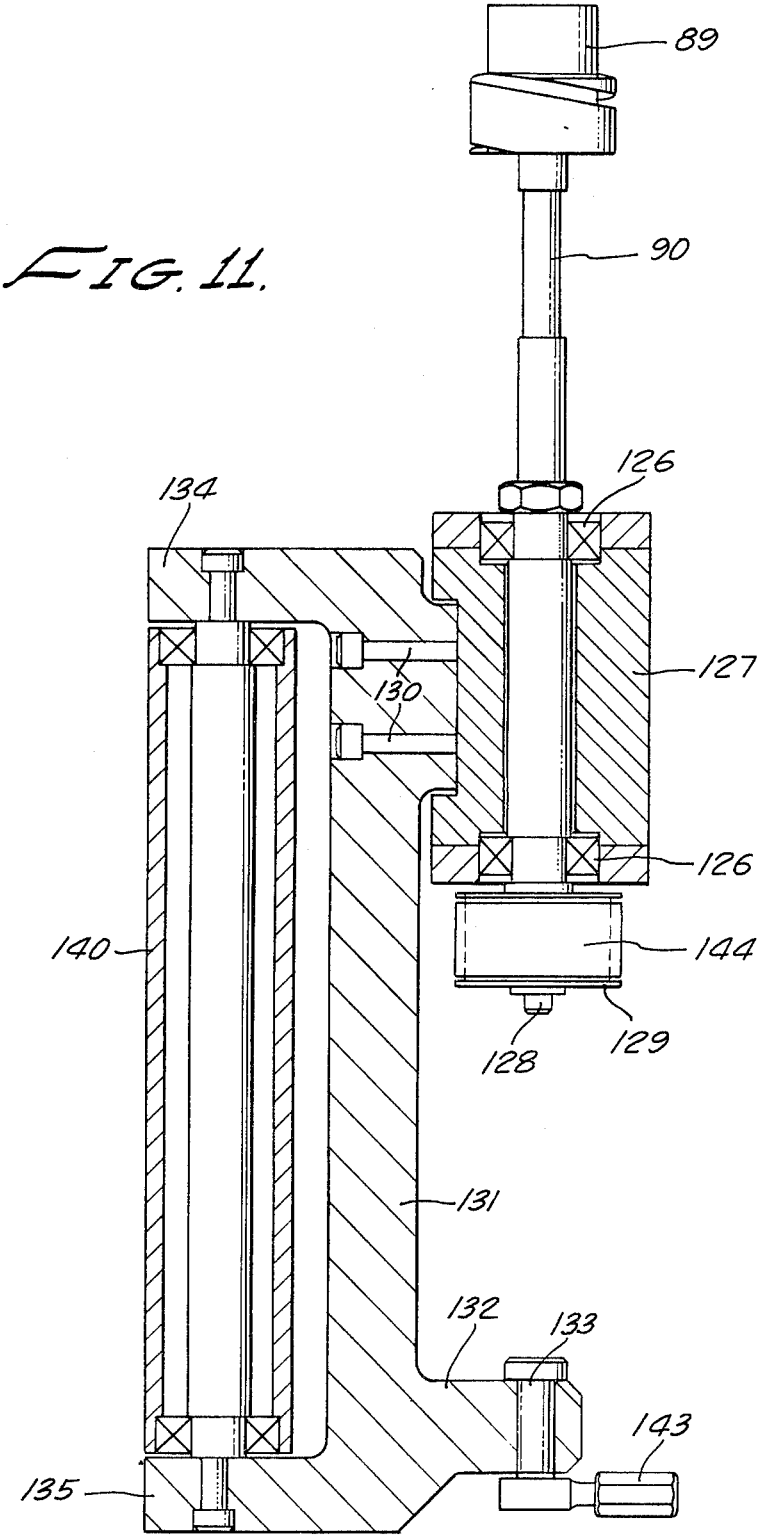
FIG. 11 is an enlarged vertical sectional detail view taken on line 11—11 of FIG. 8.

Referring now to FIG. 11, it is to be noted that a lower thickened end portion 125 of each shaft 90 journals freely in a pair of bearings 126 installed in the upper and lower ends of a bearing head 127; a lower shaft extension 128 having fixed thereon a timing belt driven pulley 129 which is identical with the aforementioned driving pulleys 120.

Each bearing head 127 thus supporting one of the denester screw drive shafts 90, is rigidly secured by a pair of screws 120 to the upper end of a vertical yoke 131 having a lug 132 at its lower end which is apertured coaxially with its bearing head 127 to receive a downwardly extending turnbuckle attaching pin 123. Extending oppositely from each other at the upper and lower ends of yoke 131 are upper and lower lugs 134 and 135 between which a cylindrical tube 140 is pivotally mounted to freely rotate relative to said yoke and said bearing head 127, on an axis parallel with shaft 90.

Figure 7:
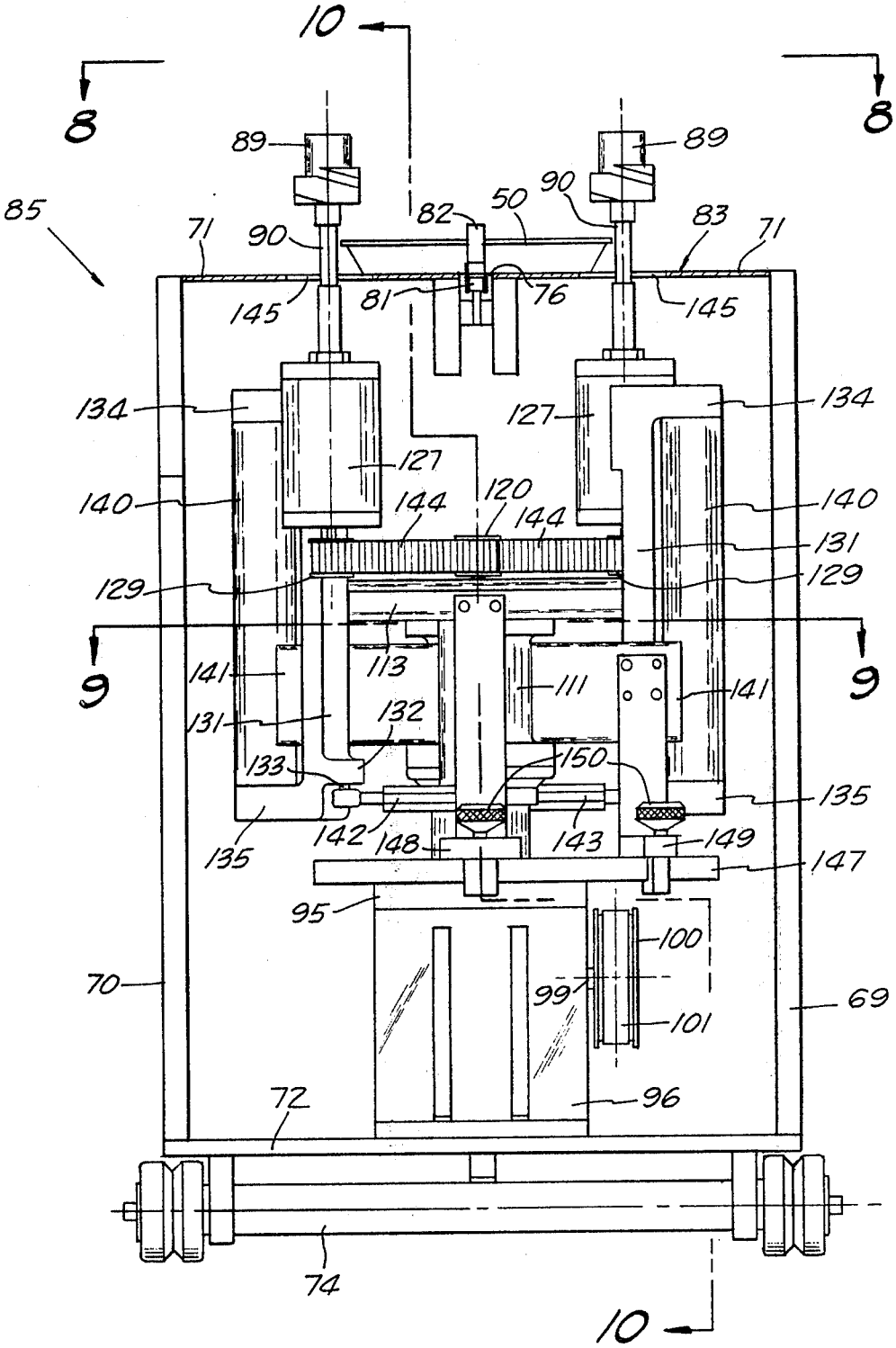
FIG. 7 is a diagrammatic front elevational view of the operating mechanism of the tray denester of the invention.

The assembly shown in FIG. 11, and just described is duplicated in the denester 85 to provide accurate support of each of the denester screws 89 by rigidly spacing the cylindrical tubes 140 from the lower external sleeve 111 so that the elements thus integrally united with said sleeve are confined to rotation as an integral assembly about axis A. This is effected by welding inner ends of a pair of tubular booms 141 to sleeve 111 at diametrically opposite points therein and welding outer extremities of booms 141 to tubes 140 to fix the latter in parallel equidistant relation with axis A, as shown in FIGS. 7, 8, and 9.

Pivot pins 133 and 119 are located at a common level in the denester 85 for the purpose of pivotally occupying apertured opposite ends of a pair of like turnbuckles 142 and 143 whereby these may be used in adjusting the spacings between the axes of the two respective pairs of drive and driven screw rotating and timing belt pulleys 120 and 129 and keeping taut two endless drive belts 144 which are trained about said pairs of pulleys and transmit rotation in the same direction from the mandrel housed drive shaft 114 to the two tray denester screws 89 and at identical speeds.

Figure 8:
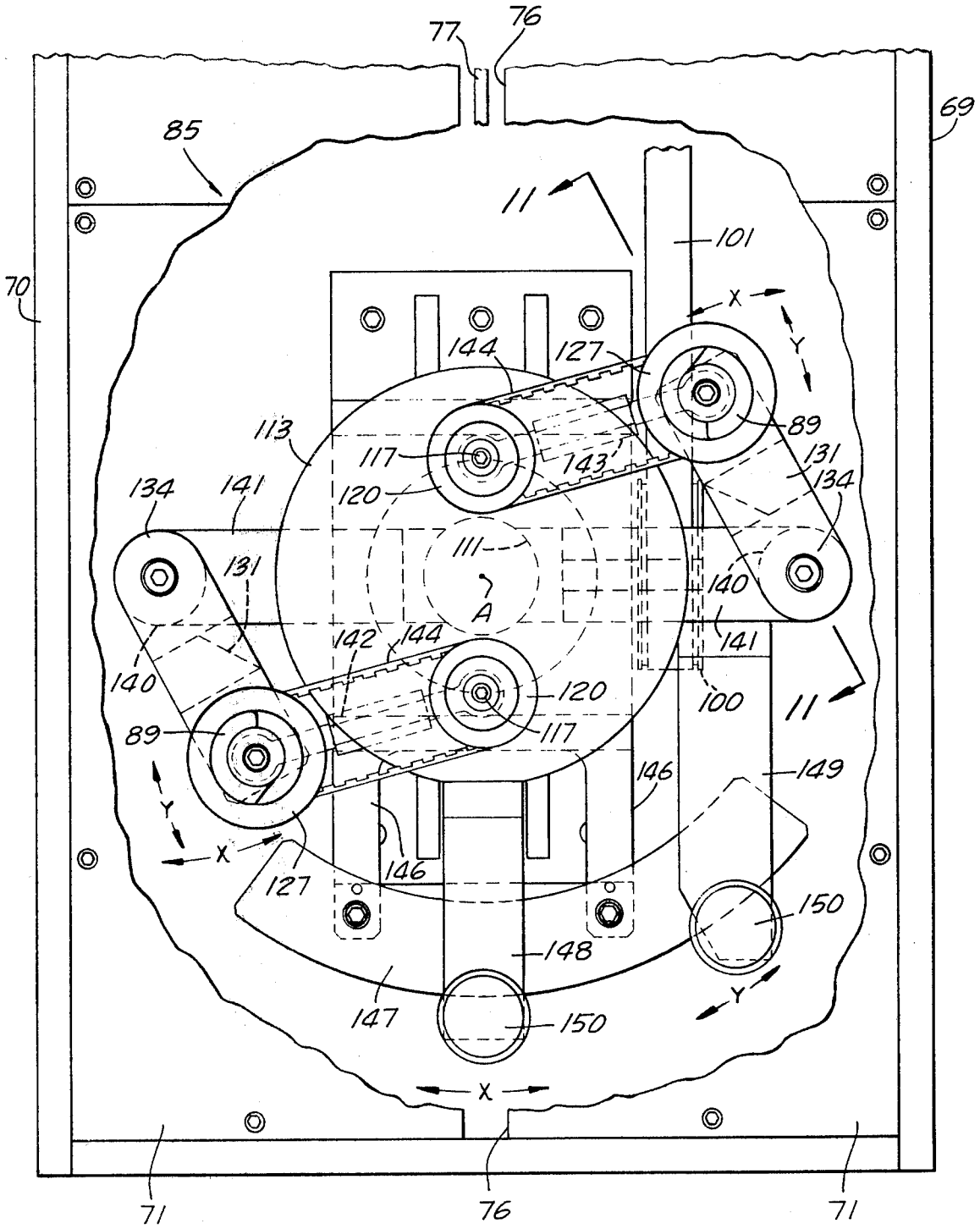
FIG. 8 is an enlarged plan view taken on line 8—8 of FIG. 7.
Figure 9:
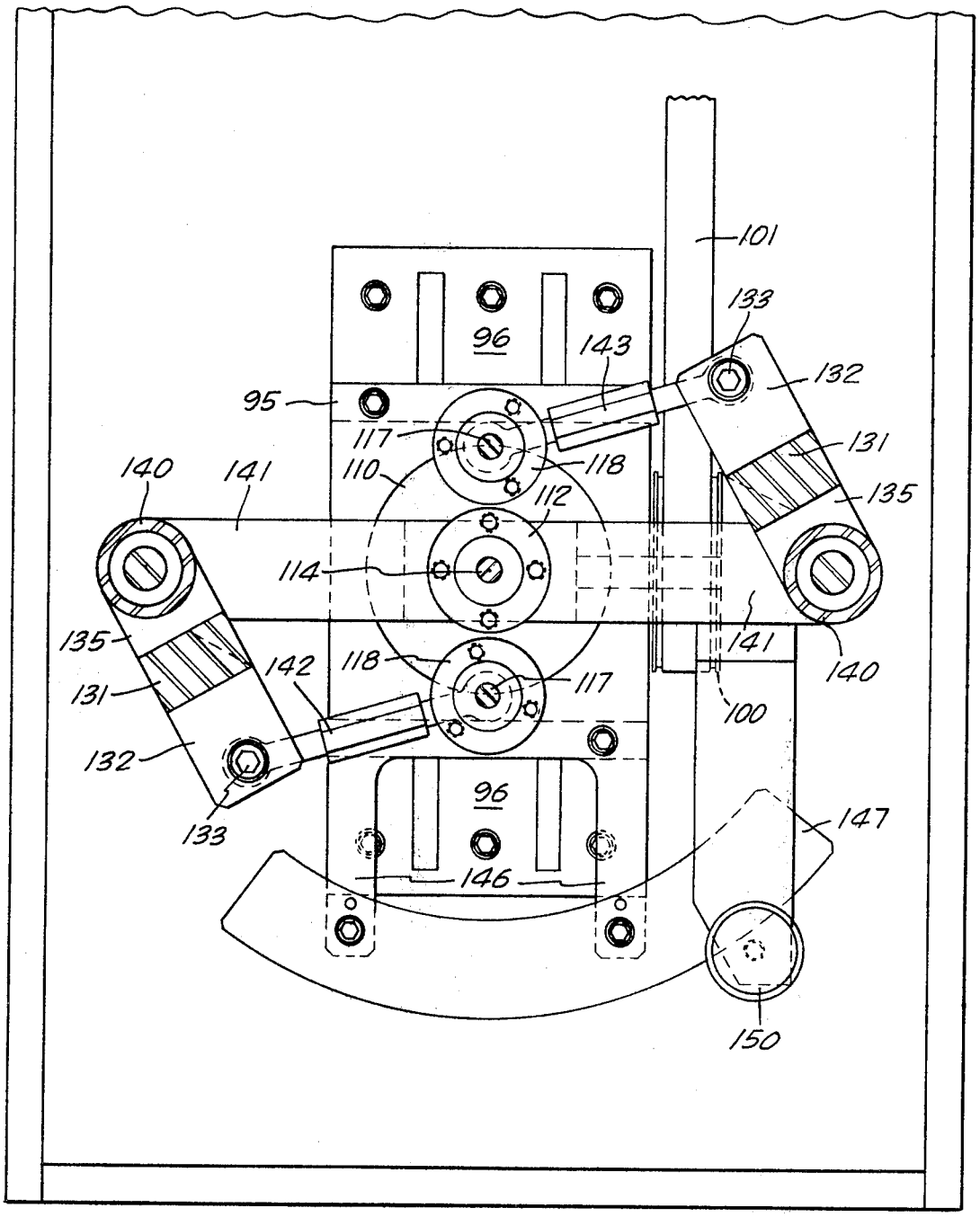
FIG. 9 is a horizontal sectional view taken on the line 9—9 of FIG. 7.
Figure 10:
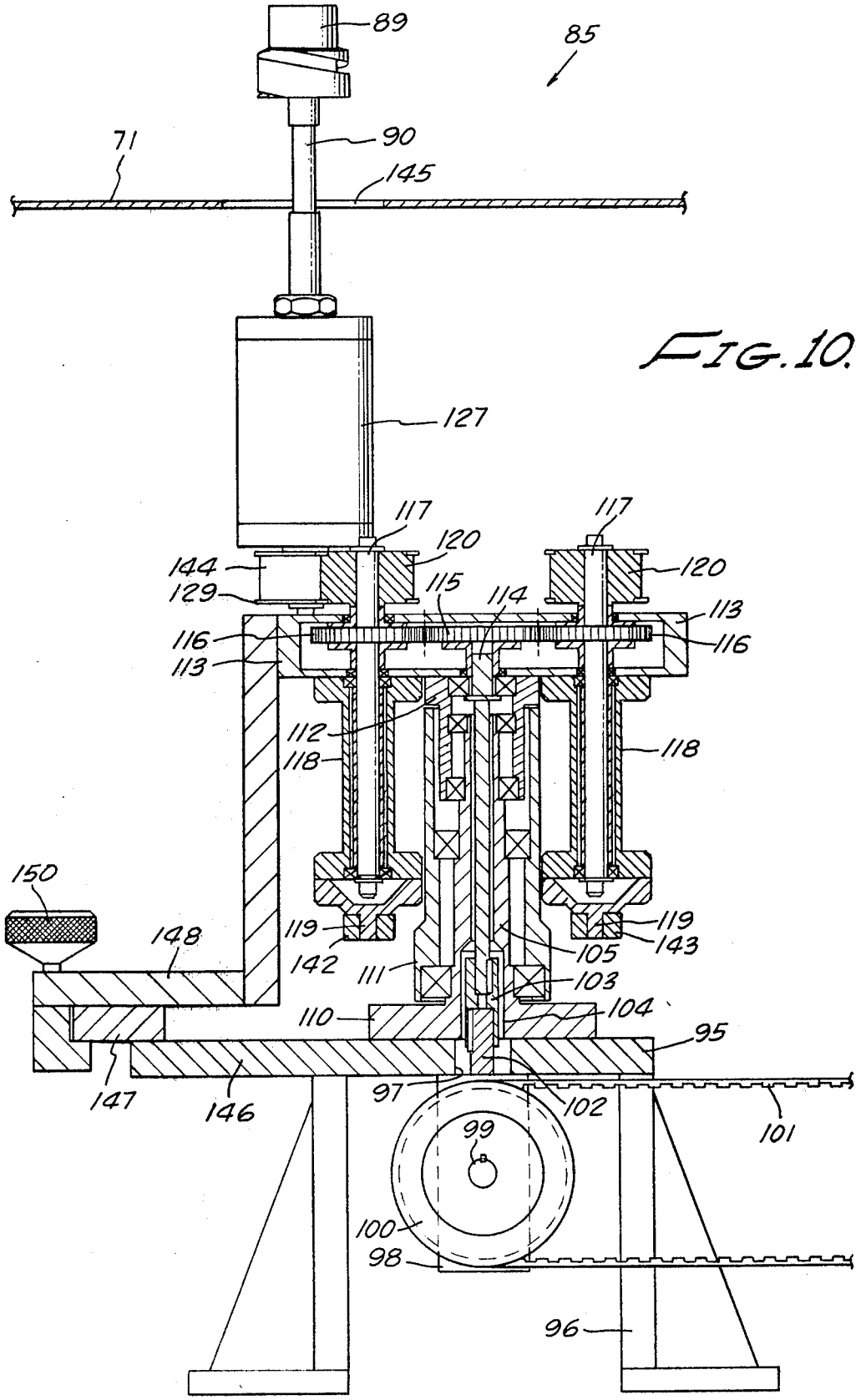
FIG. 10 is a vertical sectional view taken on the line 10—10 of FIG. 7.

Holes 145 are provided in the upper deck 71 for accommodating the passage of vertical denester screw mounting shafts 90 through said deck and allowing an adequate degree of freedom for horizontal adjustment of shafts 90 to adapt the denester mechanism 85 for handling trays 50 of different standard sizes. The controls employed for effecting this purpose may be described as follows:

Formed integrally with the denester base cover plate 95 and extending forwardly therefrom are a pair of arms 146 upon which a quadrant 147 is rigidly mounted, this quadrant being concentric with the axis A, as shown in FIG. 8.

Two control arms 148 and 149, each having the form of a right angle, are rigidly secured respectively at their upper ends to the gear box 113 and to the right hand boom 141 and extend downward from these connections and then horizontally forwardly to sweep the upper surface of quadrant plate 147. Each of the control arms 148 and 149 has at its front end a screw clamp 150 by which that arm may be held rigidly locked to quadrant plate 147 in any selected position or released therefrom for shifting said arm to a new position on said quadrant and there reset by manual rotation of the screw clamp 150 provided on that control arm. The results attainable by this multiplex control means will be more fully described in the section covering the operation of the invention.

Figure 25:
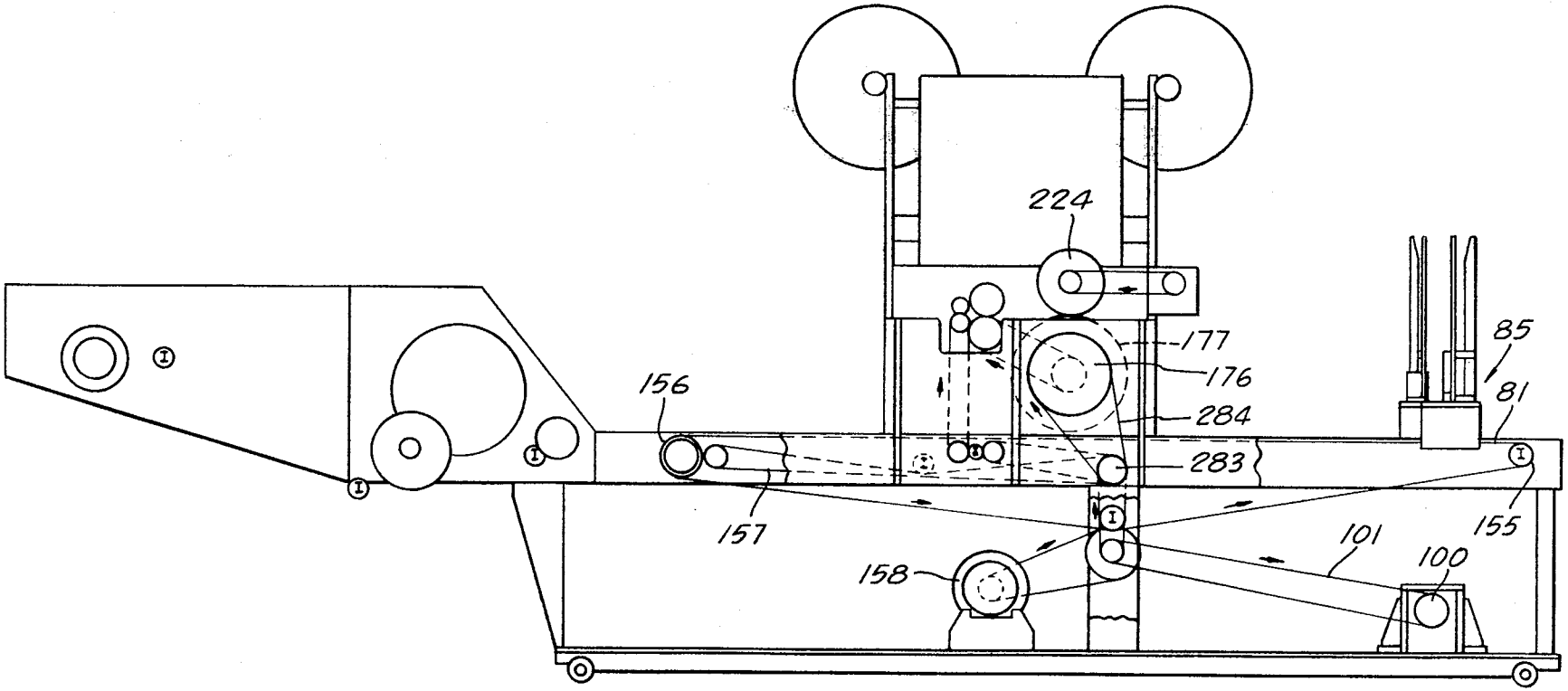
FIG. 25 is a diagrammatic rear elevational view of the invention illustrating the mechanism delivering power to the central and front end portions of the machine.

Referring to FIG. 25, it is to be noted that the tray conveyor chain 81 of the apparatus 60 turns about an idle sprocket 155 under the tray receiving area 83 of top deck 71 and about a drive sprocket 156 under the discharge end of said deck, the latter sprocket being driven through a suitable chain and gear mechanism 157 by an electric motor 158. The transmission mechanism 157 also connects the motor 158 through drive belt 101 to the drive pulley 100 of the denester mechanism 85 so that the latter mechanism and the tray conveyor 81 are constantly driven in properly timed relation, while the apparatus 60 is running, to supply the conveyor with an unbroken stream of individual trays 50, one of which is deposited in the tray receiving area 83 on top deck 71 just in advance of each of the lugs 82 of the conveyor 81, passing through said area.

Figure 16:
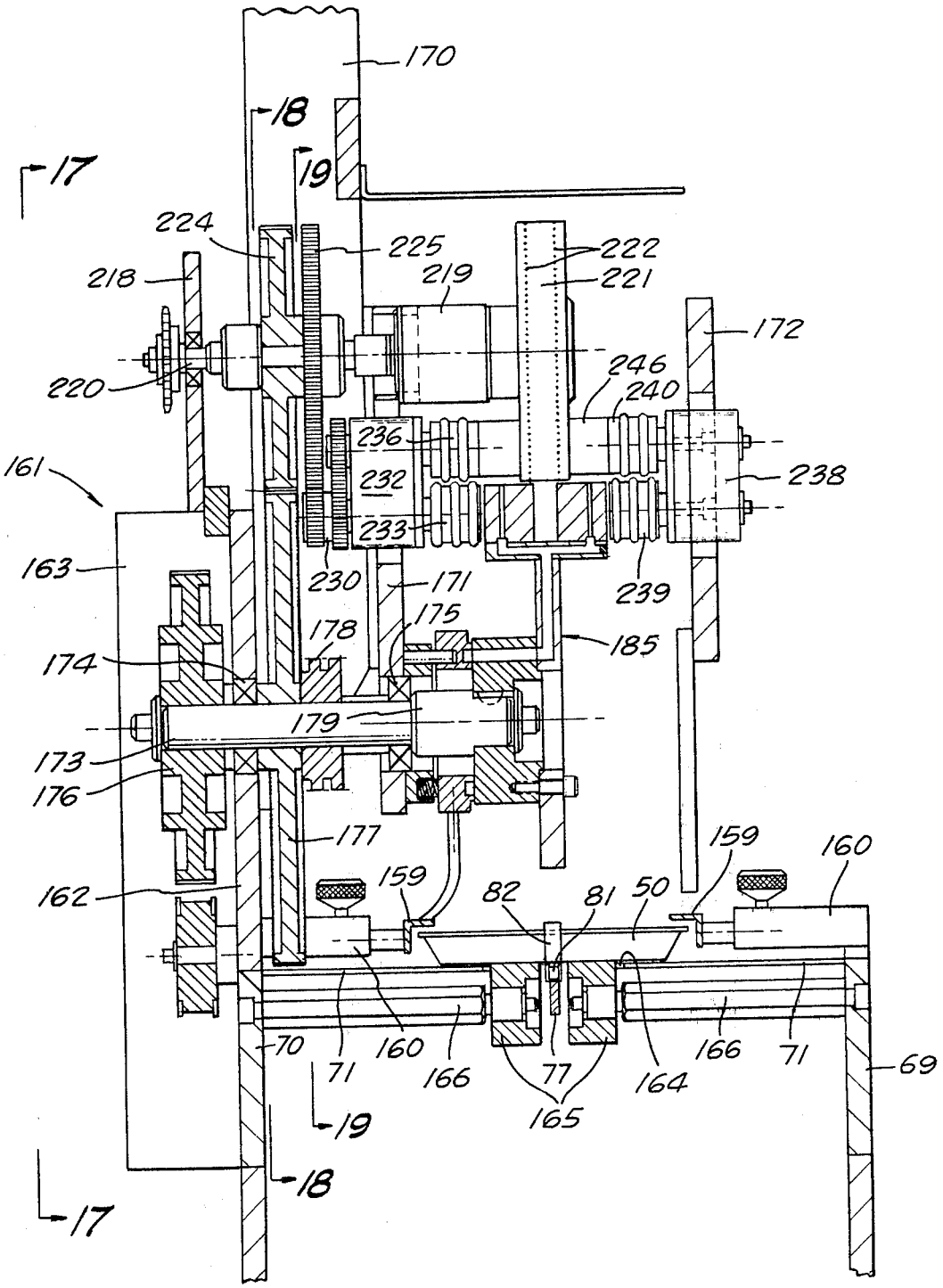
FIG. 16 is a vertical transverse sectional view taken on line 16—16 of FIG. 13 illustrating in depth, the power transmission for driving the mechanisms involved in forming and delivering absorbent pads into permanently adhering relation with each of the trays conveyed therewith.
Figure 17:
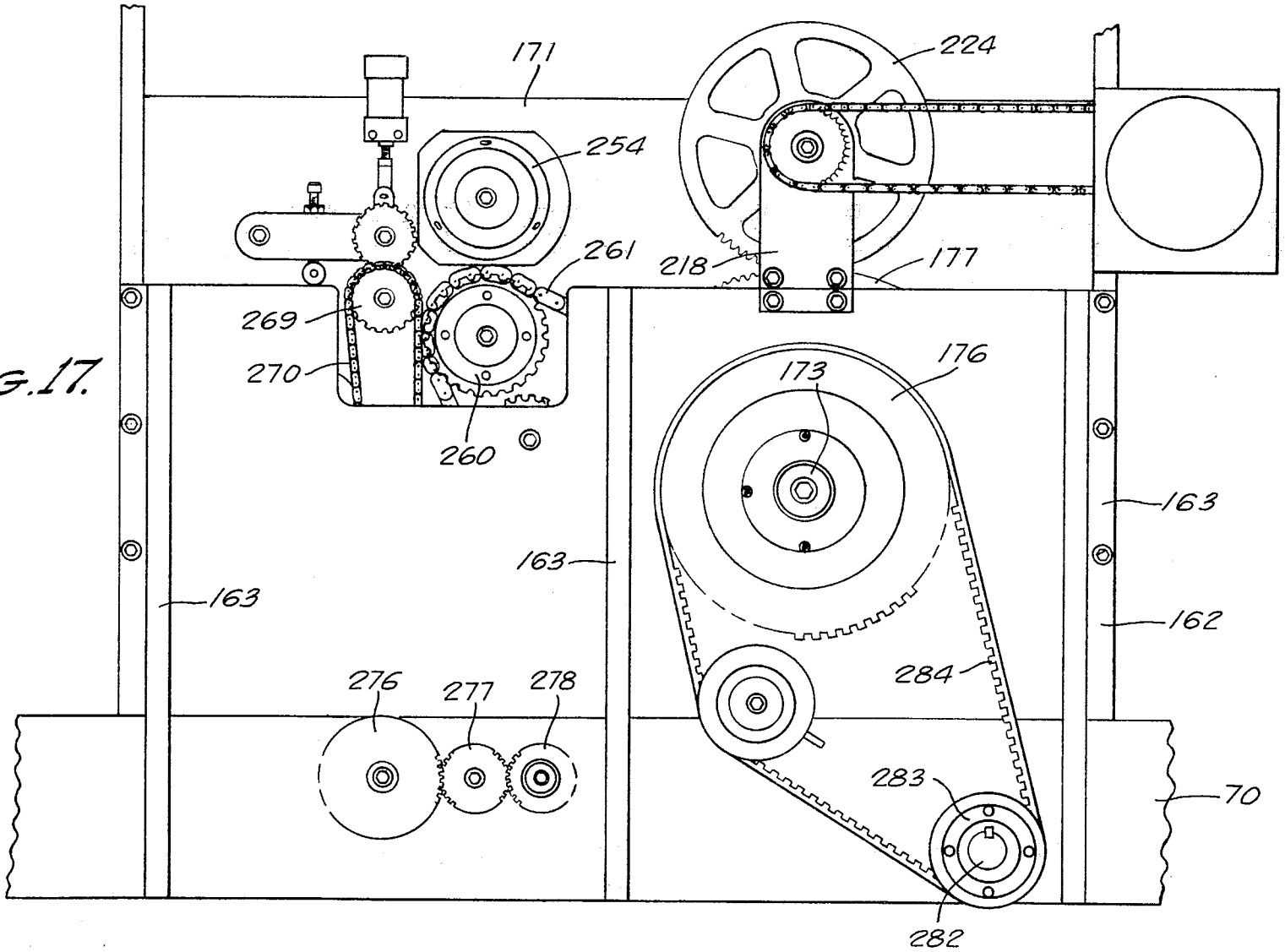
FIG. 17 is a longitudinal vertical sectional view taken on line 17—17 of FIG. 16 (a rear elevation of a central portion of the invention).
Figure 18:
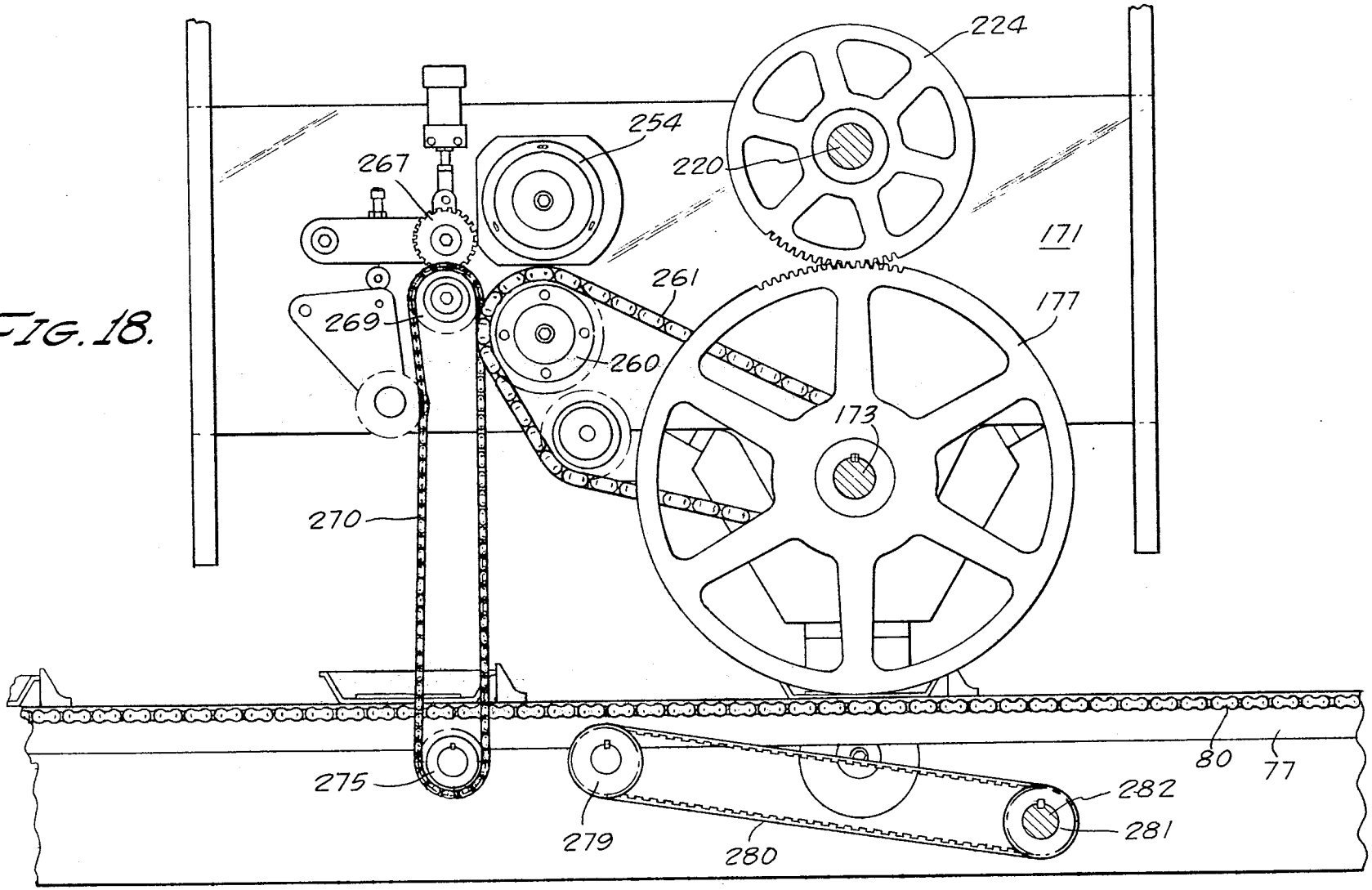
FIG. 18 is similar to FIG. 17 and is taken on line 18—18 of FIG. 16, which is located just inside the back frame wall of the invention.

Referring now to FIGS. 1 and 16, the upper deck 71 is shown as furnished with a pair of inverted angle iron tray guides 159 which are supported by cantilever telescopic guide mounts 160 fixed to upper edges of front and rear side walls 69 and 70 of housing 68. The guide mounts 160 are readily adjustable to vary the spacing of guides 159 to adapt the machine 60 to handling trays 50 of different widths. When thus set for handling a particular size of tray, the guides 159 form a straight closely confining pathway or channel along which trays of that size will be smoothly propelled by conveyor lugs 82 in properly spaced relation until discharged from the discharge end 84 of top deck 71.

Referring now to FIGS. 1, 3, and 16, the apparatus 60 is seen to include a mechanism 161 for forming a constant series of absorbent pads 65, applying glue to each of these and then pressing each pad into one of the trays travelling therebeneath within the guides 159 thereby gluing said pad to the bottom of said tray. The frame structure provided for supporting mechanism 161 includes a back plate 162 forming an upward extension of the rear side wall 70 of the apparatus housing 68. The juncture of plate 162 with side wall 70 is reinforced by vertical outside gusset plates 163.

Figure 13:
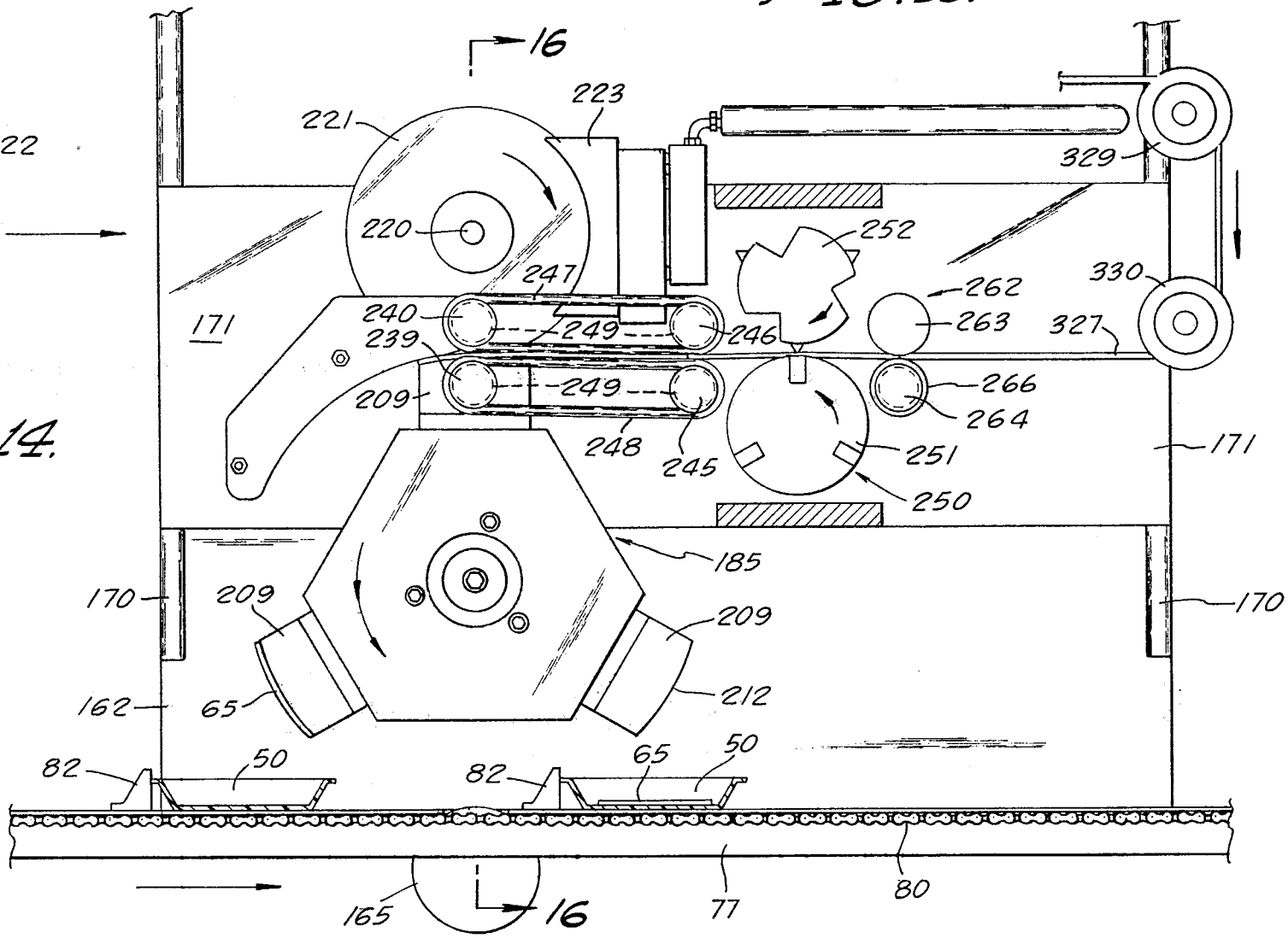
FIG. 13 is a front elevational view of FIG. 12.
Figure 14:
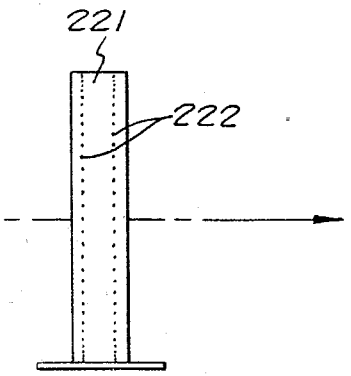
FIG. 14 is a side elevational view of the glue dispensing roller.

The principal transverse vertical operation plane of mechanism 161 is the transverse plane 16—16, in which FIG. 16 is taken on FIG. 13.

Upper deck 71 has a rectangular hole 164 formed therein which is symmetrical with the conveyor slot 76, formed centrally longitudinally therein, as well as with transverse plane 16—16 shown in FIG. 13, the hole 164 providing space in this particular area of top deck 71 to accommodate a pair of solid rollers 165 pivotally mounted coaxially but independently on the inner ends of a pair of transverse hexagonal bars 166, the outer ends of which are bolted to upper edges of housing side walls 69 and 70.

The frame of mechanism 161 is supplemented by internal gusset plates 170 which are secured at their back edges by being bolted to vertical plate 162 and in turn have bolted to their front edges a secondary longitudinal plate 171. Spaced transversely forwardly from and parallel with plate 171 is a forward longitudinal plate 172. The manner of supporting the plate 72 will be made clear later.

The main drive shaft 173 of mechanism 161 journals in bearings 174 and 175 mounted in coaxial apertures provided therefor in frame plates 162 and 171, and has fixed to its outer end a main driven timing pulley 176. Keyed to shaft 173 just inside plate 162 is a master driven gear 177 and a strip feeder and cutter drive sprocket 178. Pressed or sweat onto the inner end of shaft 173 to leave the diameter of an inner end shaft portion 179 unchanged is a local shaft thickening sleeve 180. The shaft inner end portion 179 is key seated to be received by and keyed to the hub 181 of the pad applying rotor 185 of mechanism 161.

When thus in place, hub 181 abuts against sleeve 180 and loosely coaxially confines a pair of air-vacuum valve rings 186 and 187 between rotor hub 181 and secondary longitudinal frame plate 171. Ring 186 is centered on bearing 175 and secured to frame plate 171 by three screws 188. At equal radii from the center of ring 186 it is also provided with three holes 189 (equally spaced circumferentially) and occupied by three parallel pins 190 which extend from holes 189 into three blind holes 191 in floating valve ring 187 thereby preventing rotation of ring 187 relative to fixed ring 186 although a degree of telescopic endwise relative movement between said rings is provided for by the longitudinal sliding pins 190. Ring 186 has, interspersed between bolts 188 and holes 189, three holes 192 also similarly spaced circumferencially and housing three coiled springs 193 which expand therefrom to impinge against floating ring 187 and spring bias the ground front face 194 of the latter constantly into air tight contact with the ground back face 195 of hub 181.

As shown in FIGS. 20 to 23, the floating valve ring 187 also has a segmental vacuum channel 200 machined from ground face 194 and a much shorter segmental compressed air channel 201, of the same radius and also machined therefrom. Connecting channel 200 to a vacuum tank (not shown) is a hose 202 while air channel 201 is similarly connected by a hose 203 to a compressed air tank (not shown).

Referring again to FIGS. 20, 21, and 22, the front face of hub 181 is turned down to leave an annular rib 204 to center on said hub a rotor body plate 205 having a central hole 206 fitting said rib. Three equally spaced cap screws 207, rigidly fix rotor body plate 205 thus centered on said hub. The plate 205 is an irregular hexagon forming three legs 208 mounting cleft feet 209 on their extremities, each foot including a heavy plate 210 welded at a right angle to its leg and having welded thereto a pair of symmetrically spaced blocks 211 extending radially from plate 210 and having cylindrical outer faces 212.

Four air ducts 215 open from outward leading portions of said faces 212 of each foot 209 and communicate inwardly through one of three passages 216 each of which terminates at ground face 195 of rotor hub 181 in full communication either with vacuum channel 200 or compressed air channel 201 whenever rotation of rotor 185 brings that particular passage 216 opposite said channel.

Each passage 216 pertains only to a particular one of said legs 208 and terminates at ground hub face 195 in the central radial axial plane of that leg. It thus functions to control the vacuumizing or pressurizing of the ducts 215 of that leg as rotor 185 turns in the operation of the apparatus 60. The other two passages 216 perform the same functions respectively for the other two legs of the rotor.

Journalled in a bearing 217 supported on an upward frame plate extension 218 and in a concentric bearing 219 supported by frame plate 171 (see FIGS. 12 and 16) is a glue dispenser drive shaft 220. Fixed, cantilever fashion, on the inner end of shaft 220 is a narrow cylindrical glue dispensing rotor 221 which turns in approximately tangential relation with the pad applying rotor 185 in the vertical axial plane of the tray conveyor 81.

As shown in FIGS. 12, 13, 14, and 16, the periphery of rotor 221 has two annular rows of glue carrying pits 222 adjacent its opposite ends and is constantly supplied with glue or other fluid adhesive by a wiper tank 223 closely fitting the down-turning peripheral area of said rotor.

Also fixed on shaft 220 to mesh with and be driven by master drive gear 177 is a driven gear 224 and, close inside the latter, said shaft carries a pad guide belt drive gear 225.

Figure 12:
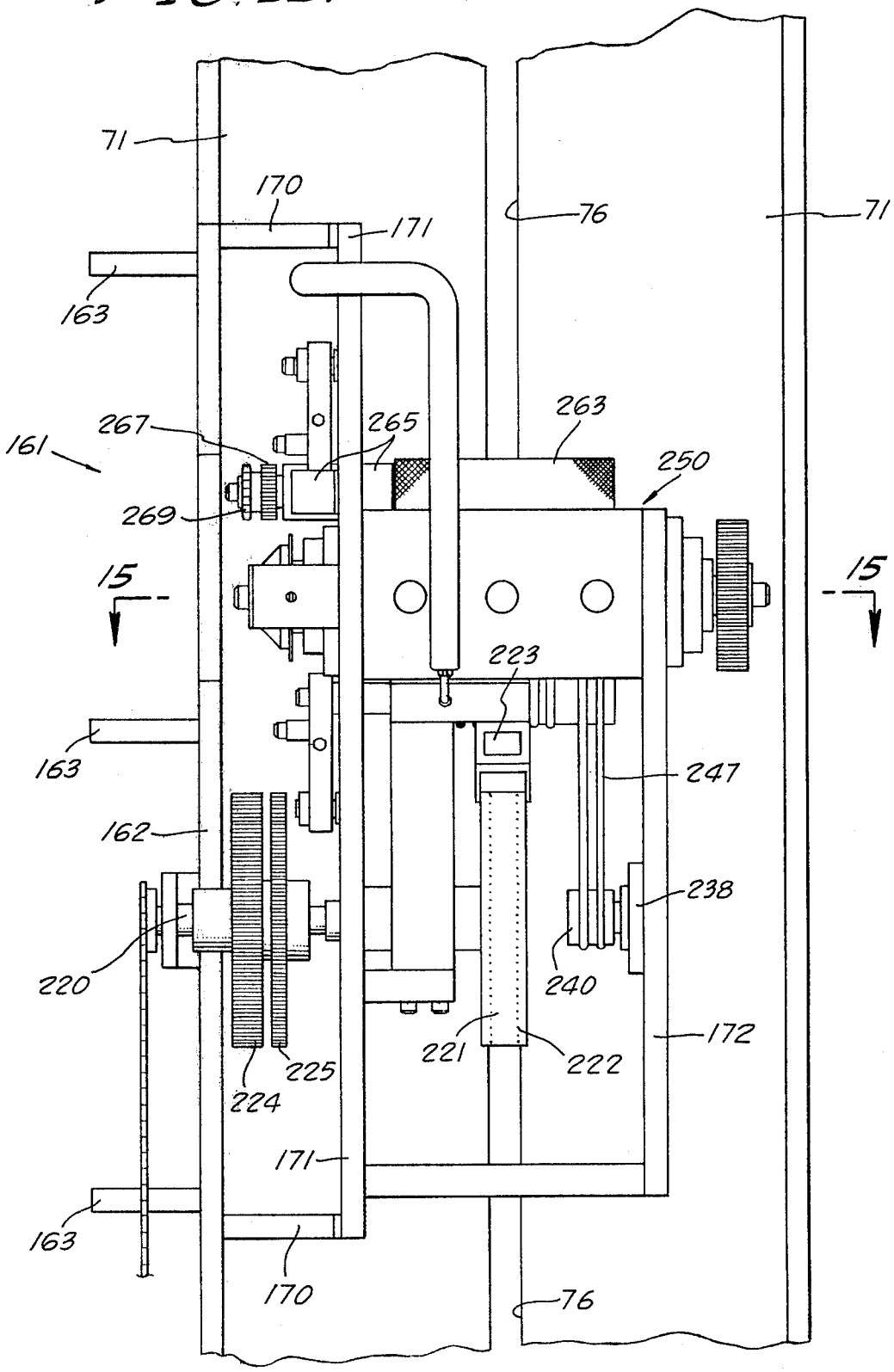
FIG. 12 is a diagrammatic plan view of the pad cutting, gluing and delivery mechanism of the invention.
Figure 19:
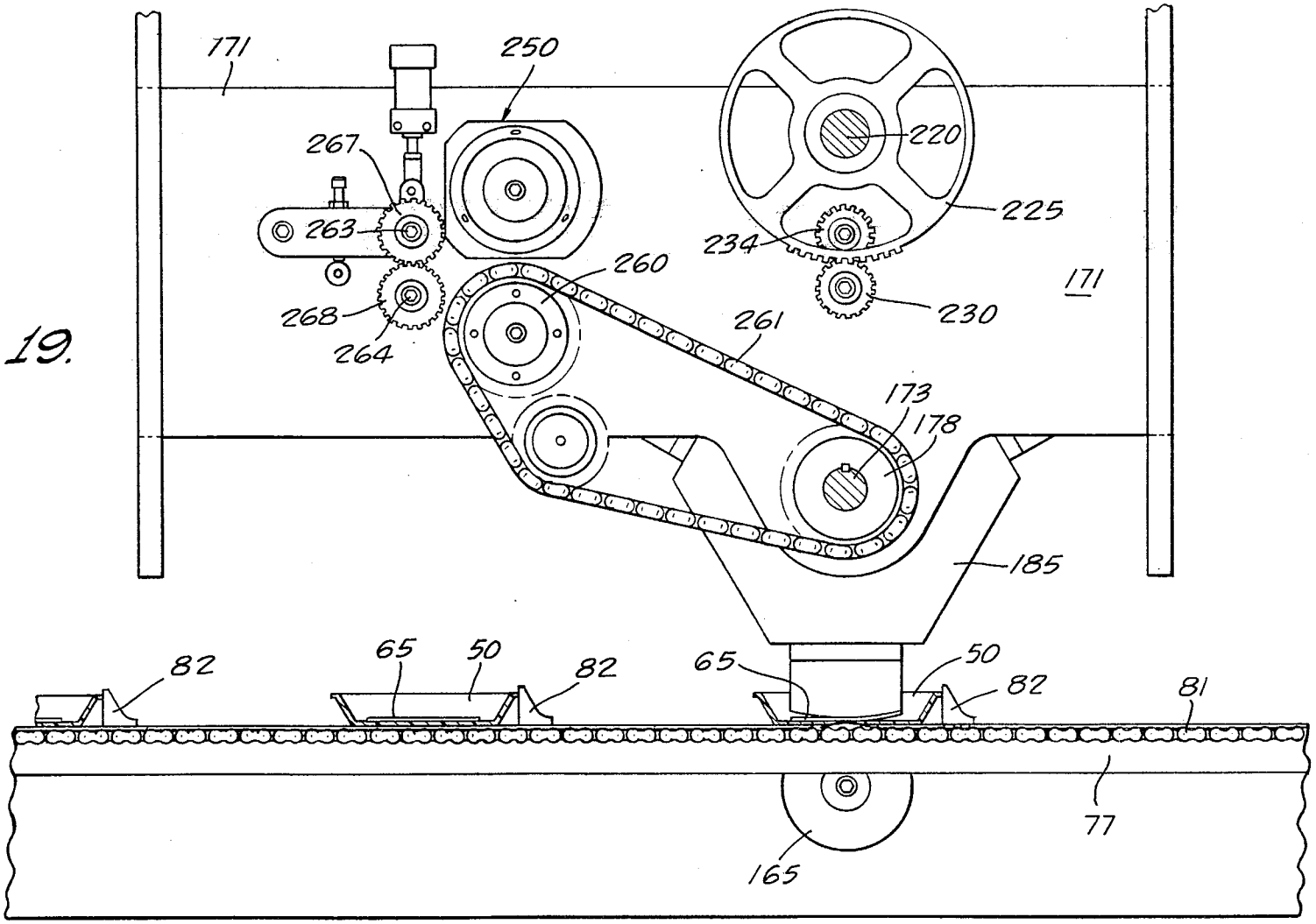
FIG. 19 is a view like FIG. 18 and is taken on line 19—19 of FIG. 16 and is located just inside the glue applicator drive gears.
Figure 20:
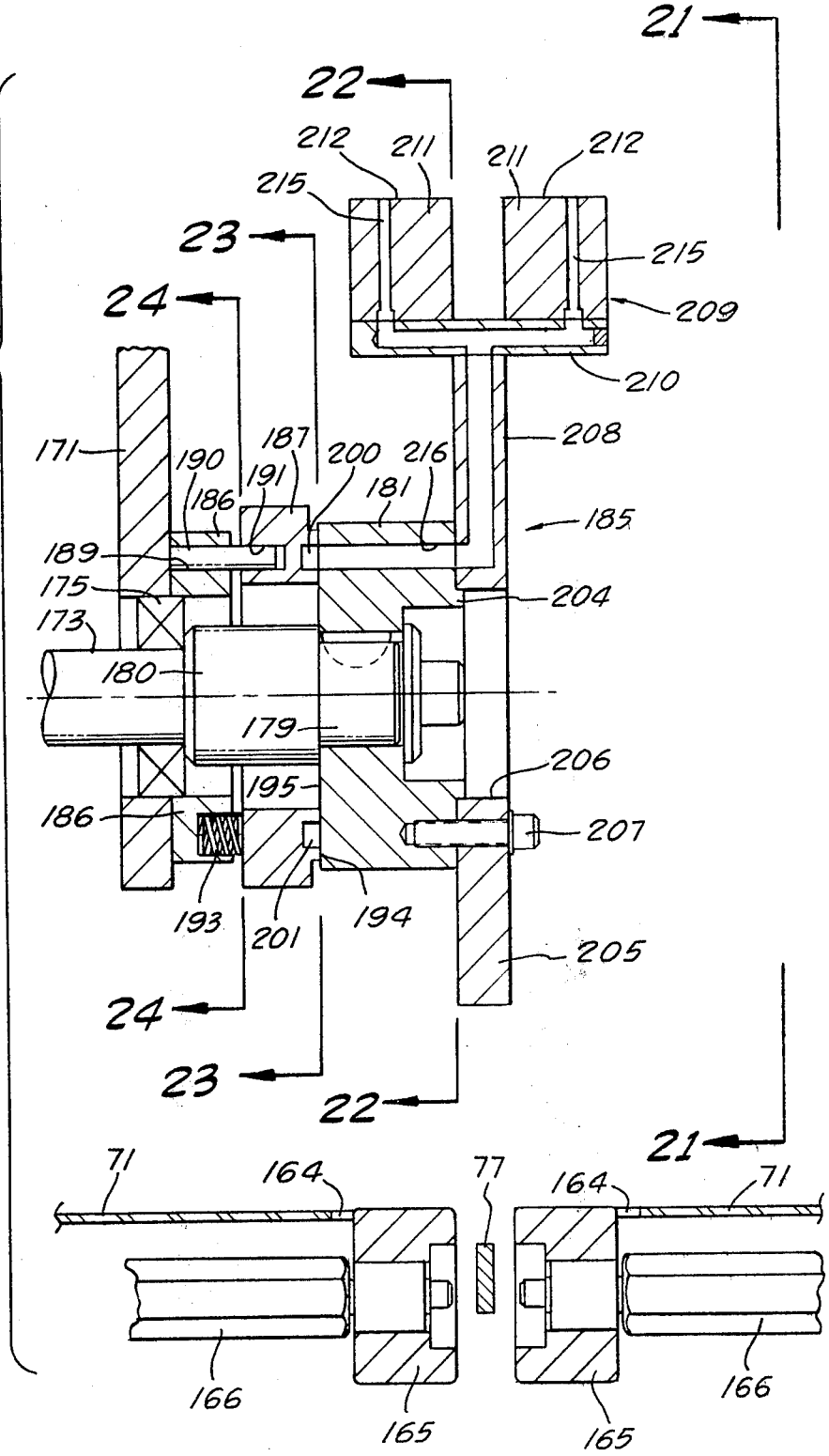
FIG. 20 is an enlarged vertical transverse sectional view of the individual pad delivery rotor and illustrates the air controls for retaining pads correctly located on the delivery rotor until each pad arrives properly located in a tray travelling directly therebeneath.
Figure 21:
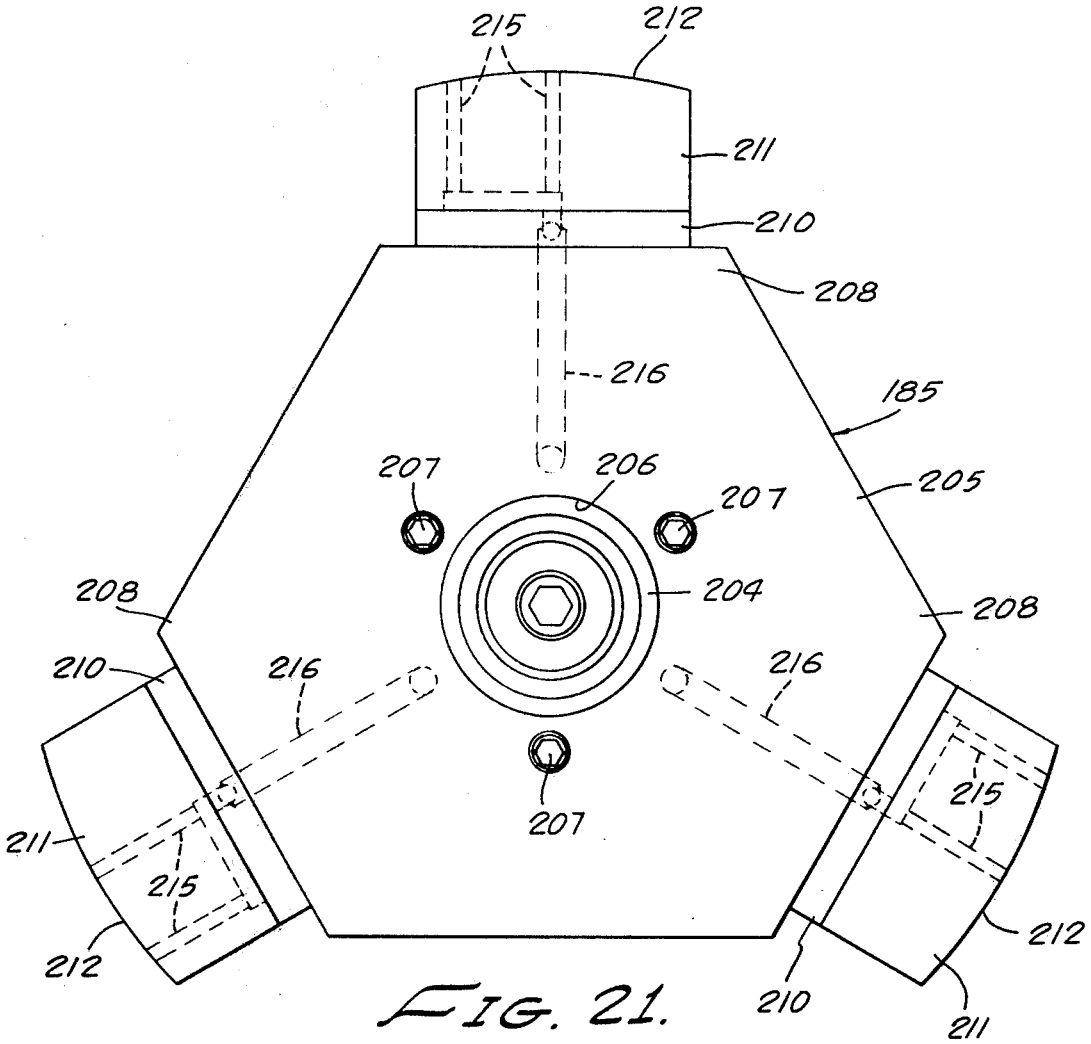
FIG. 21 is a front elevational view of the pad delivery rotor taken on line 21—21 in FIG. 20, showing, in broken lines, the internal air passages of the rotor.
Figure 22:
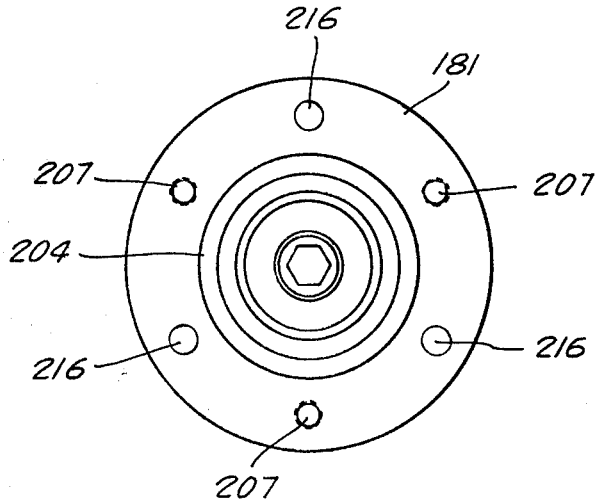
FIG. 22 is a vertical sectional view taken on line 22—22 of FIG. 24 exposing to view the front end of the rotor hub and the normally hidden three air passages in the hub which connect respectively with the peripheral air ducts opening from the three rotor feet.
Figure 23:
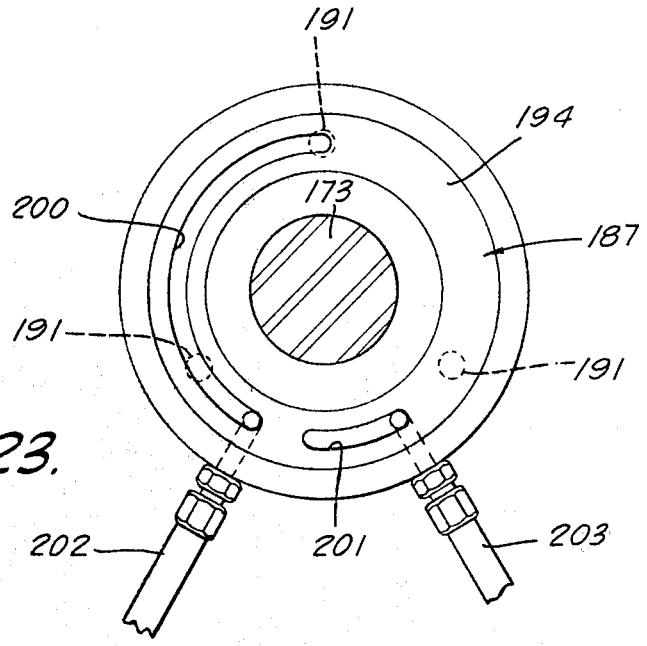
FIG. 23 is a similar view to FIG. 22, taken on line 23—23 in FIG. 20 and illustrating the front face of an air valve ring held stationary on the rotor drive shaft and spring biased against the rotor hub to control the selective vacuumizing and pressurizing of the rotor air passages as required in its delivery of absorbent pads into the trays being conveyed beneath the rotor.
Figure 24:
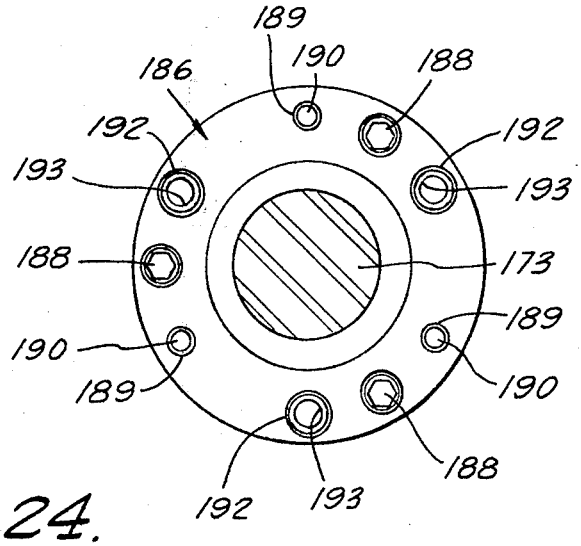
FIG. 24 is a view similar to FIG. 23 taken on line 24—24 of FIG. 20 and illustrating the anchor ring of the rotor air control valve and which is secured to the frame of the machine.

Referring now to FIGS. 12, 16, and 19, it is seen that the drive gear 225 meshes with a double length gear 230 which not only directly drives a triple belt pulley shaft 231 journalling in a double bearing 232 and carrying a triple belt pulley 233, but meshes with a gear 234 mounted on a shaft 235 also journalling in said bearing and mounting a double belt pulley 236 on its inner end.

The elements just described comprise the drive mechanism for a flexible O-ring guide belt means 237 for engaging lateral marginal portions of pads 65, as they pass between rotors 185 and 221, to assure retention by each pad of its correct orientation on its way to being delivered into a tray 50.

The belt means 237 includes a double bearing 238 mounted on frame plate 172 and supporting idle pulleys 239 and 240 in positions axially aligned with those of driven triple belt pulley 233 and driven double belt pulley 236 on the opposite side of rotor 185.

Spaced horizontally forwardly from drive pulleys 233 and 236 and idle pulleys 239 and 240 are a pair of long pulleys 245 and 246 which extend entirely through the path traveled by pads 65 enroute to rotors 185 and 221 and journal idly at their opposite ends in pairs of double bearings mounted in frame plates 171 and 172 and duplicating double bearings 232 and 238.

Double O-rings 247 of the proper length are trained about pulleys 236 and 240 and corresponding end portions of long double O-ring pulley 246; while triple O-rings 248 of the proper length are trained about pulleys 233 and 239 and corresponding end portions of long triple O-ring pulley 245.

Thus rotation of driven pulleys 233 and 236 is transmitted through double and triple O-ring belts 247 and 248 to the long pulleys 245 and 246 and from the opposite ends of the latter pulleys to the short idle bolt pulleys 239 and 240. Upper flights of triple O-ring belts 248 and matching lower flights of double O-ring belts 247 travel in the opposite direction from and at a higher rate of speed than tray conveyor 81 for a purpose to be made clear later. Pulleys 233, 236, 239, 240, 245, and 246 are provided with annular grooves 249 to maintain proper spacing of the O-rings 247 and 248 trained on said pulleys.

Figure 15:
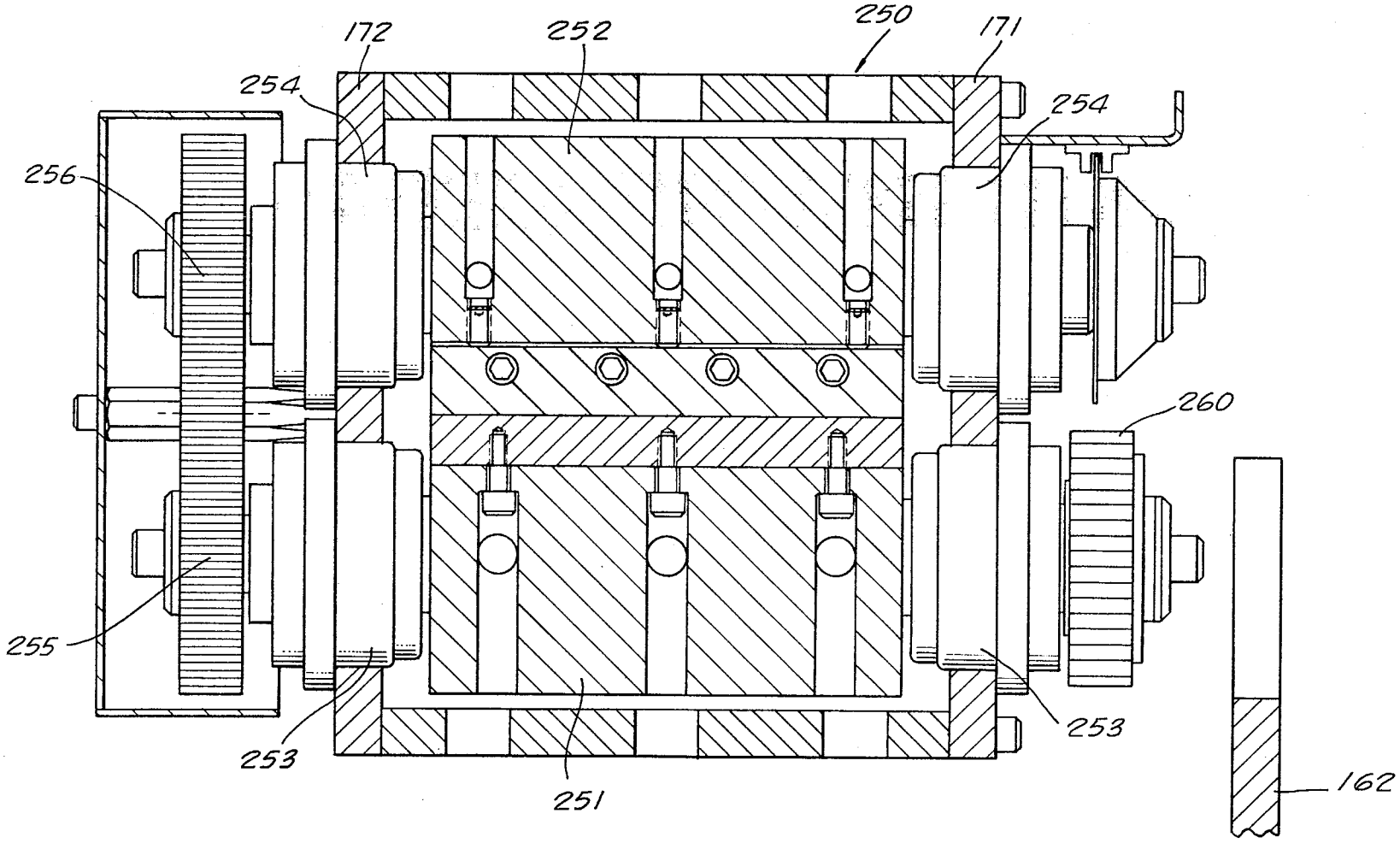
FIG. 15 is an enlarged vertical sectional view taken on the line 15—15 of FIG. 12.

Mounted between frame plates 171 and 172 as shown in FIGS. 12, 13, and 15 is a rotary absorbent pad cutter 250 having a lower three-yieldable-pad-base rotor 251 and an upper three-blade chopping rotor 252 said rotors journalling in parallel bearings 253 and 254 supported by said frame plates and having gears 255 and 256 of like pitch diameters as said rotors, and are thus constantly in mesh. Rotor 251 has a sprocket 260 mounted on its rear end which lies in the same vertical plane with drive sprocket 178 and is driven from the latter through an endless chain 261 (FIG. 19).

Closely juxtaposed with pad cutter 250 is an absorbent strip feeder 262 comprising a pair of relatively small diameter rollers 263 and 264 (See FIGS. 12, 13, 17, 18, 19, and 25). These rollers journal in two double bearings 265 mounted on frame plate 171 and extended transversely inwardly therefrom in tangential rolling engagement, at least one of these rollers having four annular sets of perforating teeth 266 for a purpose to be made clear in the operation section.

On the back side of bearings 265, rollers 263 and 264 are fitted with meshing gears 267 and 268 and one roller carries a sprocket 269 which is driven by an endless chain 270 which is trained about said sprocket and about a sprocket 275 connected by a series of three gears 276, 277, and 278 (See FIG. 17), with a sprocket 279 which is directly connected by endless chain 280 and a sprocket 281 to a main jack shaft 282 of the chain and gear mechanism 157 set up for driving the entire apparatus 60 from electric motor 158 (See FIG. 25). This jack shaft also has a sprocket 283 (FIG. 17) which is connected by an endless chain 284 to main driven sprocket 176 of the above described absorbent pad forming gluing and applying mechanism 161.

Figure 26:
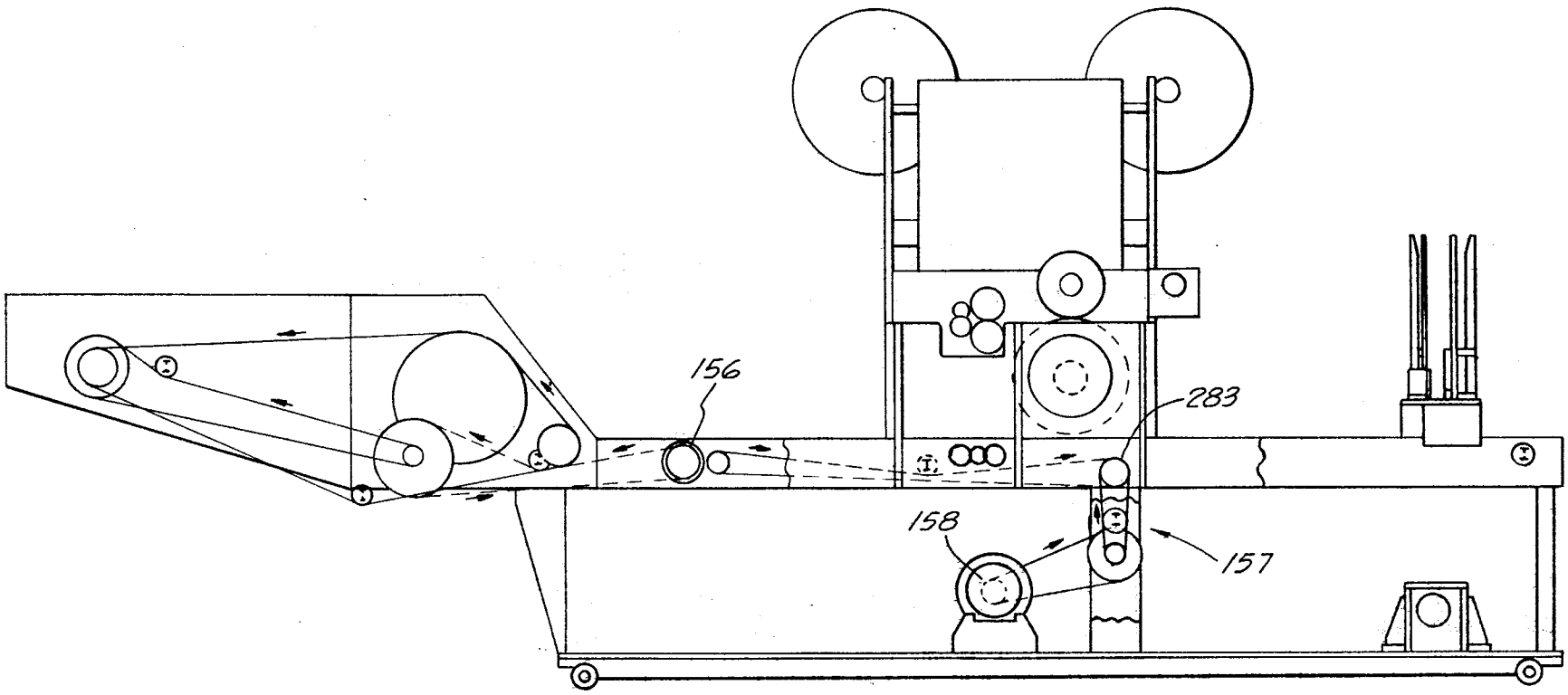
FIG. 26 is a view similar to FIG. 25 and particularly illustrates the mechanism delivering power to the central and terminal portions of the machine.
Figure 27:
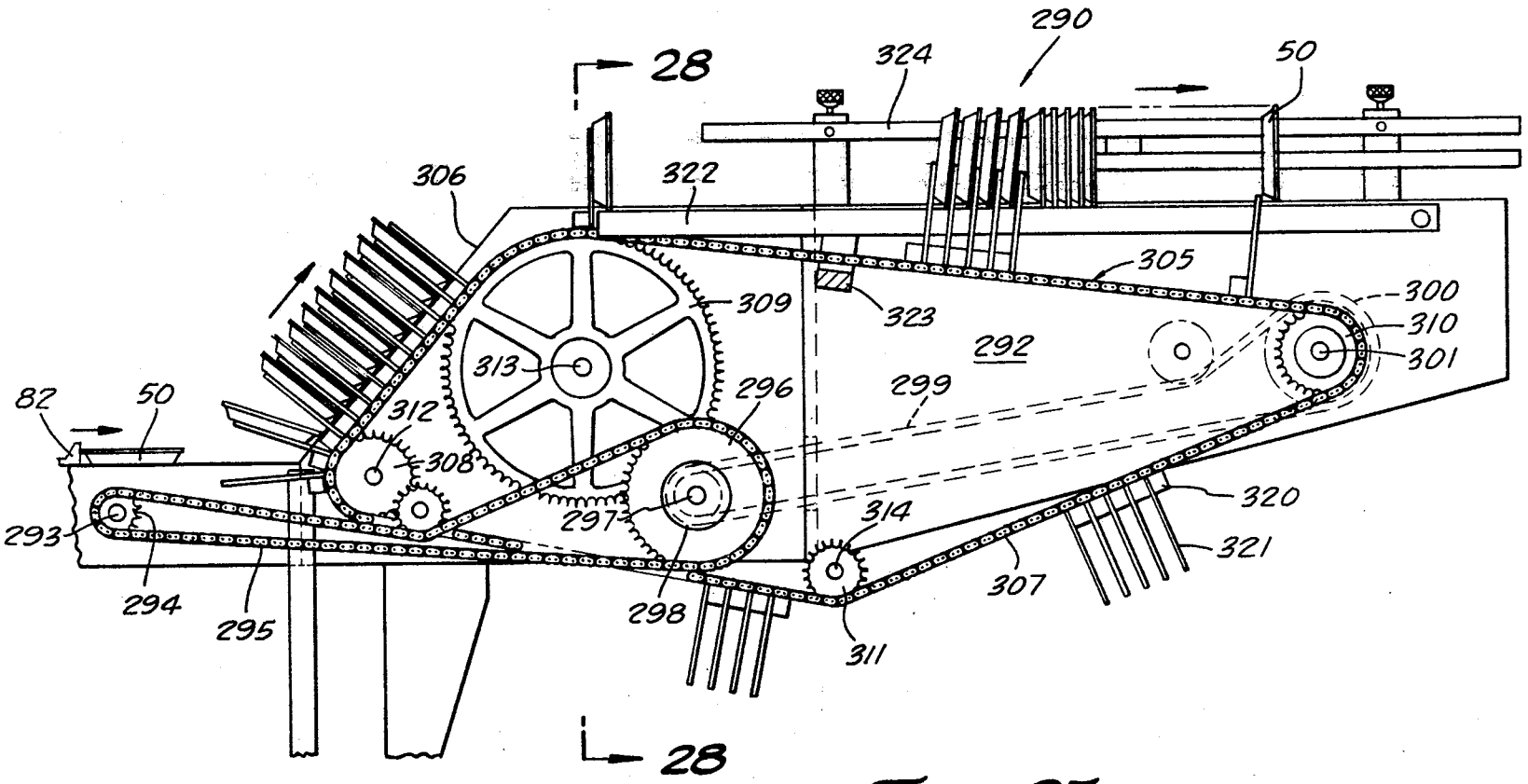
FIG. 27 is an enlarged front elevational view of the terminal portion of the invention which renests the finished product for packaging and shipment, the front frame wall being omitted from this view to disclose the internal structure normally covered thereby.
Figure 28:
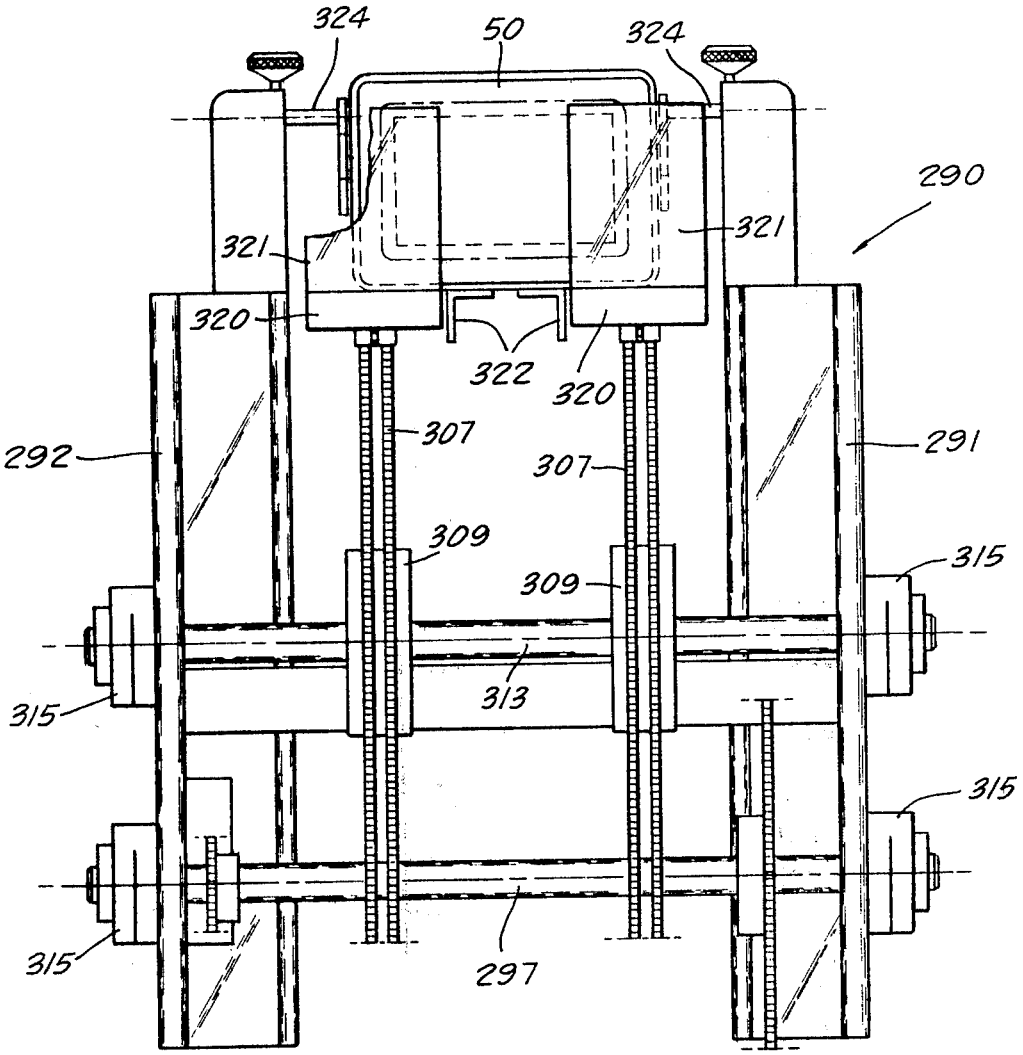
FIG. 28 is an enlarged transverse vertical sectional view taken on line 28—28 in FIG. 27, and illustrates the supporting of the trays from beneath and adjustably guiding them endwise while being recompacted for shipment.

Referring now to FIGS. 26, 27, and 28, the terminal mechanism embodied in the apparatus 60 comprises a tray renester 290 connected to the tray discharge end 184 of housing 68. The renester 290 has side walls 291 and 292, which connect to and are continuations of side walls 69 and 70, of housing 68. As shown in FIG. 27, the terminal shaft 293 of conveyor 81 on which its drive sprocket 156 is mounted, also carries a small diameter sprocket 294 which operates through an endless chain 295 to drive renester 290. This chain drives a large diameter sprocket 296 on a jack shaft 297 having a small sprocket 298 connected by a chain 299 to a larger sprocket 300 fixed on the driven shaft 301 of the creeping renester conveyor 305 of the tray renester 290.

The end edges 306 of side walls 291 and 292, contiguous with terminal ends of housing side walls 69 and 70, have an upward slope of approximately 47° from horizontal. The creeping renester conveyor 305 comprises two like sets of duplex endless chains 307 trained about axially aligned pairs of sprockets 308, 309, 310, and 311 which are mounted respectively on transversely parallel shafts 312, 313, 301, and 314, opposite ends of which journal in suitable bearings 315 provided in side walls 291 and 292.

The adjacent links in each of the duplex chains 307 have secured thereto an aluminum block 320 to which is fixed an outwardly extending light rectangular aluminum plate 321 which plates are spread slightly as they pass around sprockets 308 so as to receive in each such space a pad equipped tray 50 being expelled from the discharge end 84 of deck 71. The chain flights between sprockets 308 and 309 run parallel with sloping side wall edges 306 producing an upward tilting of plates 321 thereby retaining their supporting relation with the pad-lined trays 50 delivered, as described, to the creeping renesting conveyor 305.

FIG. 27 also shows how the upper flights of duplex chains 307 equipped with blocks 320 and plates 321 decline at a slope of about 10° so as to transfer the trays picked up by creeping conveyor 305 onto a pair of longitudinal right angle tracks 322 supported lengthwise by transverse frame bars 323 located in the vacant space separating the two duplex chain conveyors 307.

Suitable manually adjustable side guides 324 keep the trays properly centered on tracks 322 while they are being propelled along these tracks onto a counter (not shown) placed to receive the horizontally compacted pad-equipped trays and thus facilitate their being manually packaged for shipment.

As shown in FIGS. 1, 3, and 13, the vertical back frame reinforcing plates 170 support, extending transversely high over the top housing deck 71, a pair of open ended spools 325 for holding duplicate loose wound rolls 326 of highly absorbent fibrous strip material 327 the width of which makes it suitable for dividing it into an endless series of pads 65 by running said strip through the apparatus 60.

The rolls 326 are thus supported with their radial planes arranged in vertical alignment with conveyor 81. Each of the spools 325 has a spring mounted slack absorbing roller 328 from which strip 327 is optionally manually fed from either spool 325 around two flanged guide rollers 329 and 330 and into the strip feeding and protective film perforator 262.

Referring to FIG. 4, it is further noted that tray magazine guide bars 87 vary in length and are supported in cooperating magazine corner tray guiding groups on blocks 335 and 336 which are bolted to horizontal platforms 88 and that, to enable said blocks to be shifted in adjusting magazine 86 to handle a different standard commercial size of tray 50, platforms 88 are provided with optional sets of bolt holes 337 and 338 for alternate use in fastening thereto blocks 335 and 336, respectively.

OPERATION

As already pointed out, the maximum shut-down-free operation of the present invention in direct conjunction with a modern high speed hot sheet polystyrene foam tray producing press is facilitated by incorporating in the tray produced in the press the design features of one of the optional trays 50 or 51 described herein and illustrated in FIGS. 29 to 32 of the drawings. The essential tray feature required, as shown in the large scale detail view of FIG. 6 of the drawings is that each tray present to the screws 89 at opposite corners of the tray a fairly rugged pair of tray stack supporting flanges 56.

The apparatus 60 is readily adjustable to accommodate itself to trays uniformly produced in any of three standard commercial sizes.

As clearly shown in FIG. 8, adjustment of the spacing of denester rollers 89 to fit snugly diagonally opposite tray flanges 56 of trays deposited in the denester 85 is readily accomplished by the optional releasing and resetting of either or both of the control arms 148 and 149 on the fixed quandrant 147.

As previously noted, the denester 85 and the tray conveyor 81 are coordinately driven from a single electric motor 158 through a chain and gear mechanism 157 from which the other elements comprised in the invention are likewise coordinately driven as described above.

Thus when the apparatus 60 is started with an operator on duty to keep magazine 86 freshly resupplied with trays (as these are automatically fed singly to the conveyor 81) and a supervisor is available to replace the roll 326 from which an absorbent strip 327 is drawn by strip feeder 262, as such replacement becomes necessary, the apparatus 60 is able to absorb the entire output of trays 50 produced by the press for any commercial run of normal length.

Referring to FIG. 13, it is noted that as the absorbent strip 327 is drawn between upper and lower rollers of strip feeder 262, the annular rows 266 of perforating teeth on lower roller 264 produce perforations 67 in the moisture repellant cover 66 of the strip 327 which will then appear on the lower face of each of the pads 65 as they are being cut from said strip.

The strip 327, thus perforated, is propelled horizontally towards the strip chopper 250, the rollers 251 and 252 of which turn at the same peripheral speed as the strip feed rollers 263 and 264. The strip thus propelled toward the vertical transverse cutting plane of said chopper arrives at that plane just as one of the three chopper blades has passed through said plane to perform a chopping operation. There is thus a free space now between rollers 251 and 252 through which said front end of strip 327 is propelled at a speed designed to produce a pad 65 of the proper width to fit in a tray 50 when the next chopper blade arrives in rolling-chopping relation with strip 327. This frees the pad 65 thus produced from control by the strip but not before the lateral marginal areas of that pad are seized between the double upper O-ring belts 247 and the triple lower O-ring belts 248 and the front edge of this pad whisked into the horizontal notch formed by the coincidentally developing relation of tangency between glue dispensing rotor 221 and the cylindrical tread 212 of the particular foot 209 of pad applying rotor 185 under discussion.

The timing of this process is arranged so that the front edge of the pad is flush with the front edge of that tread 212 so as to be pinched between said tread and the glue dispensing rotor 221 and be rolled between those elements assuring two ribbons of glue being deposited from rows of pits 222 on a middle area of the pad. During the rolling of a pad 65 thus between glue dispenser 221 and pad feeding rotor 185, the vacuum produced, in the particular rotor foot 209 involved, tightly holds the pad 65 in its correctly oriented relation overlying the cylindrical outer faces 212 of the spaced pair of blocks 211 comprising each of the three cleft feet 209 comprised in the pad delivery rotor 185.

The precision with which a pad 65 is formed and then glued, and, incidentally thereto, precisely transferred by a vacuumized cleft foot 209 of said rotor into glued union with a tray 50 travelling therebeneath is clearly shown in FIG. 13.

The consummation of each such delivery of a pad 65 into a tray 50 is effected by the coordinate rolling of the pad 65 against the inside face of the tray bottom thus pressurally gluing the pad to the tray while simultaneously devacuumizing the air ducts 215 in each leg of rotor 185 as it finishes said pad delivery and gluing operation thus assuring retention of the pad by the glue in proper orientation with the tray.

The leading edge of the pad 65 held by vacuum in conformation with the arcuate tread 212 of the rotor foot 209 carrying said pad is lowered into pressural contact with the bottom 52 of the tray 50 being advanced to receive said pad just as said leading pad edge passes through vertical plane 16—16 shown in FIG. 13. As previously noted, this plane contains the horizontal axes of the glue dispensing rotor 221; the O-ring belt driven pulleys 233, 236, 239, and 240; the pad applying rotor 185; and the tray supporting idle rollers 165 which extend upwardly through the hole 164 formed in top deck 71 to receive said rollers.

The pad 65 and the tray bottom 52 are thus subjected to being progressively pressurally rolled together from end to end of said pad as the latter is propelled horizontally by the joint action of conveyor 81 and pad applying rotor 185 through vertical plane 16—16 in FIG. 13.

When a rotor leg 208 thus initiates its rolling relation with both a pad and a tray bottom by downward swinging into plane 16—16, the connection between its air passage 216 and vacuum channel 200 is shut off and a connection made between said passage and compressed air channel 201 thus instantly devacuumizing the air ducts 215 in said leg, thereby positively releasing the pad and tray just glued together allowing them to continue horizontal travel upon conveyor 81, while the leg 208, now devacuumized, swings upwardly out of contact with compressed air channel 201 and back into communication with vacuum channel 200 at the beginning of the next revolution of rotor 185.

Having three legs 208, rotor 185 applies, during each revolution, a pad 65 to each of three trays 50 fed consecutively by conveyor 81 through plane 16—16.

Arriving at the final product discharge end 84 of conveyor 81, the pad lined trays 50 are delivered horizontally by the lugs 82 in single sequence into successive shelf spaces 340 formed between adjacent creeping chain mounted plates 321 of creeping conveyor 305 of the tray renester 290.

The latter terminal element of the apparatus 60 is thus able to absorb its full product output by compacting the pad lined product in snuggly renested order and deliver the resulting horizontally columnized product onto a counter (not shown) from which this may be readily counted and packaged for storage or immediate shipment.

I claim:

1. In an apparatus for use in denesting rectangular foam meat packing trays and the like wherein said trays are provided with a flat bottom and sloping walls and with at least two, flat, horizontal denesting flanges located externally flush with the wall edge of the tray at a pair of diagonally opposite corners of the tray, the combination of:

a pair of course pitched screws rotatably mounted on vertical axes spaced to extend adjacent peripheral local portions of the upwardly exposed threads of said screws underneath said diagonally opposed flanges of a tray symmetrically superposed over and resting upon both of said screws;

magazine forming guide means for guiding successive nested stacks of said trays downwardly with the lowermost tray in said magazine superimposed as aforesaid on said screws;

means for synchronously rotating said screws to progressively and rapidly denest the trays in said stacks and separately deliver said trays downwardly in a predetermined timed, spaced relationship;

a frame having a lower deck and an upper deck, said upper deck being slotted centrally throughout its length;

a chain conveyor mounted on said frame in the plane of said slot and with the upper flight of said conveyor close to said upper deck and having tray propelling lugs extending upwardly through said slot at uniformly spaced intervals, said lugs travelling through a tray receiving area at one end of said upper deck and thence to the opposite or discharge end of said upper deck, said denesting screws and magazine being mounted on said frame to deliver denested individual trays downward onto said tray receiving area in timed relation with said chain conveyor, each tray being caught by the next conveyor lug rising through said deck slot and propelled along said upper deck, thereby making room in said area for receiving the next individual tray delivered into said area from said tray stack denester;

right angle rail means mounted on said frame and adjustably confining said trays being propelled by said lugs in centrally symmetrically aligned relation with said lugs; said means for rotatably mounting said screws including:

a base rigidly mounted on said lower deck on a vertical axis lying in the same plane as said upper deck slot and coinciding axially with said tray delivery area;

a hollow stationary vertical mandrel coaxially fixed to the top of said base;

a pair of telescopically overlapping lower external and upper internal sleeves freely rotatably mounted on and structurally reinforcing said mandrel;

means preventing endwise movement of said sleeves relative to each other or to said mandrel;

a flat circular gear box fixed coaxially on the upper end of said internal sleeve and substantially peripherally overlying said internal sleeve;

coplanar gear means in said gear box including a central drive gear and two diametrically opposed driven gears;

mitered gear drive means in said base including a female spline extending upwardly vertically into the hollow lower end of said mandrel and a horizontal shaft and sprocket for chain driving said apparatus;

a floating drive shaft extending downward into said hollow mandrel into splined relation with said female spline and having said central drive gear fixed to its upper end;

two driven gear driven shafts passing vertically through said gear box and having said driven gears keyed thereto;

two tubular shaft and bearing housing means mounted on and extending vertically downwardly from said gear box to terminate at the same level in two turnbuckle mounting axial pins;

two timing belt drive pulleys mounted on upwardly extending ends of said gear box driven shafts;

two co-planar horizontal tubular booms welded to opposite sides of said rotatable external mandrel-reinforcing sleeve;

two cylindrical vertical tubes welded near their lower ends to the outer ends of said booms;

two vertical yokes with parallel terminal ears overlapping opposite ends of said tubes and freely rotatably united therewith, each yoke also having an ear oppositely extending from its lower end and a bearing block oppositely extending from its upper end;

two vertically spaced pairs of bearing means in said bearing blocks and two pivot pins concentric with said pairs of bearing means and extending downward from said last recited ears at the same horizontal level with the aforerecited two turnbuckle mounting axial pins;

two screw mounting shafts vertically mounted in said pairs of bearing means and each extending downwardly therefrom to mount a belt driven timing pulley and upwardly therefrom to mount a tray denester screw;

endless drive belts entrained about said pairs of drive and driven timing pulleys; and turnbuckles terminating in self-aligning bearings which fit over said pins and permit adjustment of the tension on said endless drive belts; and means for adjusting the spacing of said tray denesting screws by controlled rotation of at least one of said rotatable sleeves, while fixing the other such sleeve against rotation.

2. A combination as recited in claim 1 wherein:

said last recited means effects its purpose by controlled rotation of the internal sleeve about said hollow mandrel while preventing rotation of said external sleeve about said hollow mandrel.

3. A combination as recited in claim 1 wherein:

said last recited means effects its purpose by controlled rotation of the external sleeve about said hollow mandrel while preventing rotation of said internal sleeve about said hollow mandrel.

4. A combination as recited in claim 1 wherein:

said last recited means effects its purpose by the joint controlled rotation of both of said internal and external hollow mandrel reinforcing sleeves relative to said mandrel and setting said sleeves in selected adjusted positions relative to said mandrel.

* * * * *

UNITED STATES PATENT AND TRADEMARK OFFICE

CERTIFICATE OF CORRECTION

PATENT NO. : 4,260,311
DATED : April 7, 1981
INVENTOR(S) : Mark J. Hanses

It is certified that error appears in the above—identified patent and that said Letters Patent is hereby corrected as shown below:

Column 7, line 37, "72" should read -- 172 --.

Column 7, line 66, "circumferencially" should read -- circumferentially --.

Column 11, line 26, "quandrant 147" should read -- quadrant 147 --.

Signed and Sealed this

*Eighteenth* Day of *August 1981*

[SEAL]

*Attest:*

GERALD J. MOSSINGHOFF

*Attesting Officer*

*Commissioner of Patents and Trademarks*